US005208416A

United States Patent [19]

Hayakawa et al.

[11] Patent Number: 5,208,416

[45] Date of Patent: May 4, 1993

[54] AUTOMATIC PERFORMANCE DEVICE

[75] Inventors: Tokuji Hayakawa; Yorihisa Yamaguchi; Takeo Shibukawa, all of Hamamatsu, Japan

[73] Assignee: Yamaha Corporation, Hamamatsu, Japan

[21] Appl. No.: 861,430

[22] Filed: Mar. 31, 1992

[30] Foreign Application Priority Data

Apr. 2, 1991 [JP] Japan ..... 3-096200

[51] Int. Cl.[5] ..... G10H 1/38; G10H 1/40; G10H 7/00

[52] U.S. Cl. ..... 84/634; 84/DIG. 12; 84/DIG. 22

[58] Field of Search ..... 84/609-614, 84/634-638, DIG. 12, DIG. 22

[56] References Cited

U.S. PATENT DOCUMENTS 4,089,245 5/1978 Dietrich ..... 84/DIG. 12
4,314,493 2/1982 Kondo .
4,326,441 4/1982 Imamura et al. ..... 84/DIG. 12
4,357,854 11/1982 Hirano ..... 84/DIG. 12
4,839,810 6/1989 Abe .
4,889,026 12/1989 Abe ..... 84/611
4,936,183 6/1990 Rauchi .

FOREIGN PATENT DOCUMENTS 63-298296 12/1988 Japan .
2-99996 4/1990 Japan .

*Primary Examiner*—Stanley J. Witkowski
*Attorney, Agent, or Firm*—Graham & James

[57] ABSTRACT

In a case where a fill-in pattern is temporarily inserted during an automatic performance, not only a main pattern to which the performance pattern should be shifted but also a main pattern which has been performed immediately before are taken into account and a fill-in pattern is automatically determined in accordance with a combination of the two main patterns. In a case where an introduction pattern is inserted at the beginning of the automatic performance, an introduction pattern is automatically determined depending upon which main pattern is performed after the introduction performance. In a case where an ending performance is inserted at the end of the automatic performance, an ending pattern is automatically determined depending upon which main pattern has been performed immediately before the ending. In a case where, during a fill-in performance, an operation for designating another fill-in performance has been made, the fill-in performance which is being performed is continued and, as to the main pattern to which the pattern should be shifted, one which is designated later is given priority. Transient performance patterns such as fill-in, introduction and ending are automatically determined in these manner and an automatic performance which is rich in variety can be realized.

11 Claims, 14 Drawing Sheets

AUTOMATIC PERFORMANCE DEVICE

BACKGROUND OF THE INVENTION

This invention relates to an automatic performance device used in an electronic musical instrument or the like instrument and, more particularly, to an automatic performance device carrying out an automatic performance according to a desired automatic performance pattern such as an automatic rhythm performance and an automatic bass/chord accompaniment performance. More particulary, the invention relates to a technique for automatically selecting a transitional automatic performance pattern such as fill-in, introduction or ending pattern.

In a conventional automatic rhythm performance used in an electronic musical instrument, plural rhythm patterns are normally provided for a common rhythm name and a desired one of these rhythm patterns is selected. For example, a normal pattern and a variation pattern are provided for the rhythm name of bosanova and one of these patterns can be selected. The variation pattern is not limited to a single type but there is also a device in which plural variation patterns are provided. Each of these patterns generally has a length of several bars and a continuous automatic rhythm performance is carried out by repeating such pattern.

Since the same pattern is repeated as a main performance pattern as described above, the automatic performance tends to become monotonous. For avoiding such monotonousness, in a prior art automatic performance device (e.g., U.S. Pat. No. 4,936,183), a sub-pattern called "fill-in" or "break" or "ad lib" is provided and this sub-pattern is temporarily inserted in response to designation made by manual switch operation to be followed by performance of a main pattern. In this case, a main pattern which should follow the temporarily inserted sub-pattern such as fill-in, i.e., a main pattern to be shifted is designated, and the type of the sub-pattern is solely determined in accordance with the type of the designated main pattern to be shifted.

In a case where, for example, there are two types of main performance pattern, i.e., the normal pattern and the variation pattern, two types of fill-in designation switches are provided, i.e., for "fill-in-to-normal" (i.e., a designation of shifting to the normal pattern after performance of fill-in) and "fill-in-to-variation" (i.e., a designation of shifting to the variation pattern) and two types of fill-in patterns are correspondingly provided. When, therefore, the "fill-in-to-normal" designation has been made, the fill-in automatic performance according to the fill-in pattern exclusive for "fill-in-to-normal" is made regardless of whether the pattern which has been performed immediately before is the normal pattern or the variation pattern. Likewise, when the "fill-in-to-variation" designation has been made, the fill-in automatic performance according to the fill-in pattern exclusive for "fill-in-to-variation" is made regardless of the type of the main pattern which has been performed immediately before.

In the prior art automatic performance device, an introduction performance pattern and an ending performance pattern are provided in addition to the main performance patterns for the purpose of introducing vividness of a live performance in the automatic performance. The introduction performance pattern is inserted at the beginning of the automatic performance and the ending performance pattern is inserted at the end of the automatic performance. In this case, a performance according to a predetermined introduction pattern is simply inserted by an introduction designation operation and a performance according to a predetermined ending pattern is inserted by an ending designation operation.

Since the sub-pattern such as fill-in used in the prior art automatic performance device is determined solely in accordance with the type of the main pattern to which the pattern should be shifted after insertion of the sub-pattern, there arise problems that transition from the main pattern which has been performed immediately before tends to become unnatural and the fill-in performance itself tends to become monotonous. For example, in the case of the fill-in to be followed by the normal pattern, the same fill-in pattern is used regardless of whether the main pattern immediately before is the normal pattern or the variation pattern and, therefore, the same fill-in performance is carried out both in a case where the pattern returns from the normal pattern to the normal pattern after insertion of the fill-in and in a case where the pattern is shifted from the normal pattern to the variation pattern after insertion of the fill-in, with the result that the automatic performance is accompanied by monotonousness.

Further, in the prior art automatic performance device, a predetermined introduction pattern is solely determined by an introduction designation operation as described above and this causes monotonousness in the introduction performance. Likewise, a predetermined ending pattern is solely determined by an ending designation operation and this causes monotonousness also in the ending performance.

There may sometimes arise a case where, during a transitional performance such as fill-in, an operation for designating another transitional performance such as fill-in is made. In the prior art automatic performance device, however, no specific arrangement is made to cope with such case and therefore such case cannot be handled properly without causing inconvenience.

The above described problems take place not only in the automatic rhythm performance but also in the automatic bass/chord accompaniment performance and other automatic performances.

SUMMARY OF THE INVENTION

It is, therefore, an object of the invention to provide an automatic performance device capable of carrying out a performance which is minimized in monotonousness occurring when a sub-pattern such as fill-in is temporarily inserted in the middle of an automatic performance.

It is another object of the invention to provide an automatic performance device capable of carrying out an introduction performance which is minimized in monotonousness occurring when the introduction performance has been inserted at the beginning of an automatic performance.

It is another object of the invention to provide an automatic performance device capable of carrying out an ending performance which is minimized in monotonousness occurring when the ending performance has been inserted at the end of an automatic performance.

It is still another object of the invention to provide an automatic performance device capable of executing a necessary processing properly without inconvenience in a case where, during a transient performance such as fill-in, an operation for designating another transient performance such as fill-in has been made.

An automatic performance device according to the first aspect of the invention comprises a performance pattern memory section for storing plural main patterns and plural sub-patterns, a selection section for selecting a desired first main pattern, a first control section for reading out the first main pattern selected by said selection section from said memory section and carrying out an automatic performance of the read out main pattern, an instruction section for designating a second main pattern, so as to instruct shifting to a performance of the second main pattern after temporarily inserting a performance of a sub-pattern during the automatic performance, a determination section responsive to the designation by said designation section for automatically determining the sub-pattern to be inserted in accordance with a combination of the second main pattern designated by said instruction section and the first main pattern which has been performed immediately before the designation, and a second control section for reading out the sub-pattern determined by said determination section from said memory section and carrying out the automatic performance of the sub-pattern and, thereafter, reading out the desired main pattern which has been designated by said designation means from said memory means and carrying out an automatic performance according to the desired pattern.

According to the automatic performance device of the first aspect of the invention, plural sub-patterns are stored in the performance memory section. When shifting to a performance of the second desired main pattern after temporarily inserting a performance of a sub-pattern has been instructed by the instruction section, the sub-pattern is not determined solely by the second main pattern according to the designation but the sub-pattern to be inserted is determined by the determination section in accordance with a combination of the second main pattern and the first main pattern which has been performed immediately before the instruction. Accordingly, the sub-pattern is automatically determined having regard not only to the second main pattern to which the pattern should be shifted but also the first main pattern which has been performed immediately before whereby the transisional performance of the sub-pattern can be made automatically with various modes of change in accordance with a combination of the first and second main performances before and after the transitional performance so that monotonousness in the transitional performance can be prevented.

An automatic performance device according to the second aspect of the invention comprises a performance pattern memory section for storing plural main patterns prepared for each of plural styles, and plural introduction patterns, a first selection section for selecting a desired style from among the plural styles, second selection section for selecting a desired main pattern from among the plural main patterns of the style selected by said first selection section, an introduction performance instruction section for instructing an automatic performance according to an introduction pattern at the beginning of an automatic performance, an introduction pattern determination section responsive to the instruction by said introduction performance instruction section for automatically determining an introduction pattern in accordance with the main pattern selected by said second selection section, a control section for reading out the introduction pattern determined by said introduction pattern determination section from said memory section and carrying out the automatic performance of the introduction pattern and, thereafter, reading out the main pattern selected by said second selection section from said memory section and carrying out an automatic performance of the main pattern.

According to the automatic performance device of the second aspect of the invention, plural introduction patterns are stored in the performance pattern memory section. When the introduction performance has been instructed by the introduction performance instruction section, the introduction pattern is not determined solely by this instruction but it is determined automati7 cally by the introduction determination section in accordance with the main pattern selected by the selection section. Accordingly, the introduction pattern can be automatically determined with various modes of change depending upon which main pattern is performed after the introduction pattern whereby monotonousness in the introduction performance can be prevented.

An automatic performance device according to the third aspect of the invention comprises a performance pattern memory section for storing plural main patterns prepared for each of plural styles, and plural ending patterns, first selection section for selecting a desired style from among the plural styles, a second selection section for selecting a desired main pattern from among the plural main patterns of the style selected by said first selection section, a first control section for reading out the main pattern selected by said second selection section from said memory section and carrying out an automatic performance of the read out main pattern, an ending performance instruction section for instructing an automatic performance of an ending pattern at the end of the automatic performance, an ending pattern determination section responsive to the instruction by said ending performance instruction section for automatically determining an ending pattern in accordance with the main pattern which has been performed immediately before the instruction, and a second control section for reading out the ending pattern determined by said ending pattern determination section from said memory section and carrying out the automatic performance of the ending pattern.

According to the automatic performance device of the third aspect of the invention, plural ending patterns are stored in the performance pattern memory. When the ending performance has been instructed by the ending performance instruction section, the ending pattern is not determined solely by this instruction but is automatically determined by the ending determination section in accordance with the main pattern which has been performed immediately before this instruction. Accordingly, the ending pattern can be automatically determined with various modes of change depending upon which main pattern has been performed immediately before the ending whereby monotonousness in the ending performance can be prevented.

An automatic performance device according to the fourth aspect of the invention comprises a performance pattern memory section for storing plural main patterns and plural sub-patterns, an instruction section for instructing shifting to a performance of a desired main pattern after temporarily inserting a performance of a sub-pattern during the performance, a first control section responsive to the instruction by said instruction section for reading out a sub-pattern from said memory section and carrying out an automatic performance of the read out sub-pattern and, thereafter, reading out the desired main pattern from said memory section and carrying out an automatic performance of the main pattern and second control section for controlling said first control section in such a manner that in a case where, during the automatic performance of the sub-pattern, shifting to a performance of another main pattern after performance of another sub-pattern has been instructed by said instruction section, the main pattern which is to be performed thereafter will be changed to said other main pattern without changing the sub-pattern which is being performed.

According to the automatic performance device of the fourth aspect of the invention, in a case where, during the automatic performance of the sub-pattern, shifting to a performance of another main pattern after performance of another sub-pattern has been instructed, the main pattern which is to be performed thereafter is changed to the other main pattern without changing the sub-pattern which is being performed. Accordingly, when an operation for instructing another transitional performance such as fill-in has been made during performance of a transitional performance such as fill-in, continuity of the fill-in which is being performed can be secured and, in the meanwhile, as to the main pattern to which the pattern should be shifted, one which is designated later is given priority so that a proper processing can be performed.

Embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
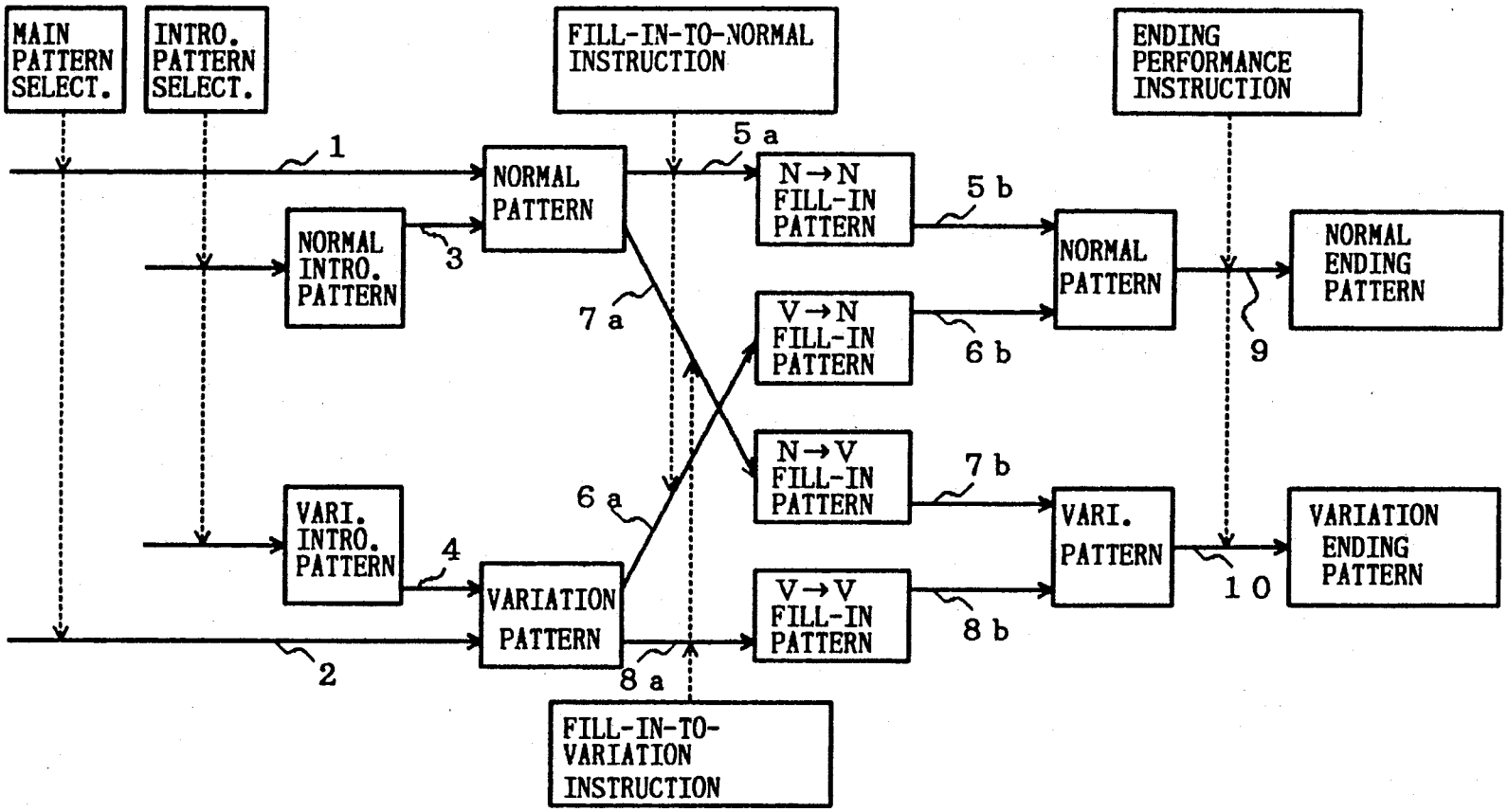
FIG. 1 is a diagram showing schematically an example of a flow of the performance pattern according to the invention.

Referring first to FIG. 1, a specific example of change in the pattern according to an embodiment of the invention will be schematically described with respect to a case where the main pattern is either a normal pattern or a variation pattern. FIG. 1 schematically shows a flow of the pattern change in an automatic performance.

By selecting the main pattern, either the normal pattern or the variation pattern is selected. When introduction performance has not been instructed, the automatic performance is started in accordance with the selected pattern (the route of reference character 1 or 2).

When introduction performance has been instructed, either one of two different introduction patterns (i.e., either a normal introduction pattern or a variation introduction pattern) is automatically selected depending upon the type of the selected main pattern and thereafter the pattern is shifted to the main pattern. When the selected main pattern is the normal pattern, the automatic performance is started according to the normal introduction pattern and thereafter the pattern is shifted to the normal pattern (the route of reference character 3) whereas when the selected main pattern is the variation pattern, the automatic performance is started according to the variation introduction pattern and thereafter the pattern is shifted to the variation pattern (the route of reference character 4).

As sub-patterns for a fill-in performance, four different patterns, i.e., "N→N fill-in pattern", "V→N fill-in pattern", "N→V fill-in pattern" and "V→V fill-in pattern", are provided. It should be noted that "N" is an abbreviation of "normal", "V" an abbreviation of "variation" and "→" designates the direction of shifting. For example, "N→V fill-in pattern" indicates the pattern which is used when the main pattern before the fill-in performance is the normal pattern and the main pattern after the fill-in performance is the variation pattern.

When "fill-in-to-normal" designation which instructs that the pattern should be shifted to the normal pattern after the fill-in performance has been made during the automatic performance, "N→N fill-in pattern" is automatically selected when the pattern which was performed immediately before this designation was the normal pattern and, after the fill-in performance according to this pattern, the pattern is shifted to the normal pattern (the route of reference characters **5*a* and 5*b*). On the other hand, when the pattern which was performed immediately before this designation was the variation pattern, "V→N fill-in pattern" is automatically selected and, after the fill-in performance according to this pattern, the pattern is shifted to the normal pattern (the route of reference characters 6*a*, 6*b***).

When "fill-in-to-variation" designation which instructs that the pattern should be shifted to the variation pattern after the fill-in performance has been made, "N→V fill-in pattern" is automatically selected when the pattern which was performed immediately before this designation was the normal pattern and, after the fill-in performance according to this pattern, the pattern is shifted to the variation pattern (the route of reference characters *7a* and *7b*). On the other hand, when the pattern which was performed immediately before this designation was the variation pattern, "V→V fill-in pattern" is automatically selected and, after the fill-in pattern according to this pattern, the pattern is shifted to the variation pattern (the route of reference characters *8a* and *8b*).

When an ending performance instruction has been made, either one of two different ending patterns (i.e., a normal ending pattern and a variation ending pattern) is automatically selected depending upon the type of the main pattern which was performed immediately before this instruction and, after an automatic performance according to the ending pattern is made, the performance is ended. When the main pattern immediately before this instruction is the normal pattern, the ending performance is made according to the normal ending pattern (the route of reference character 9) whereas when the main pattern immediately before this instruction is the variation pattern, the ending performance is made according to the variation ending pattern (the route of reference character 10).

An embodiment of an electronic musical instrument incorporating the automatic performance device according to the invention will now be described more specifically.

Figure 2:
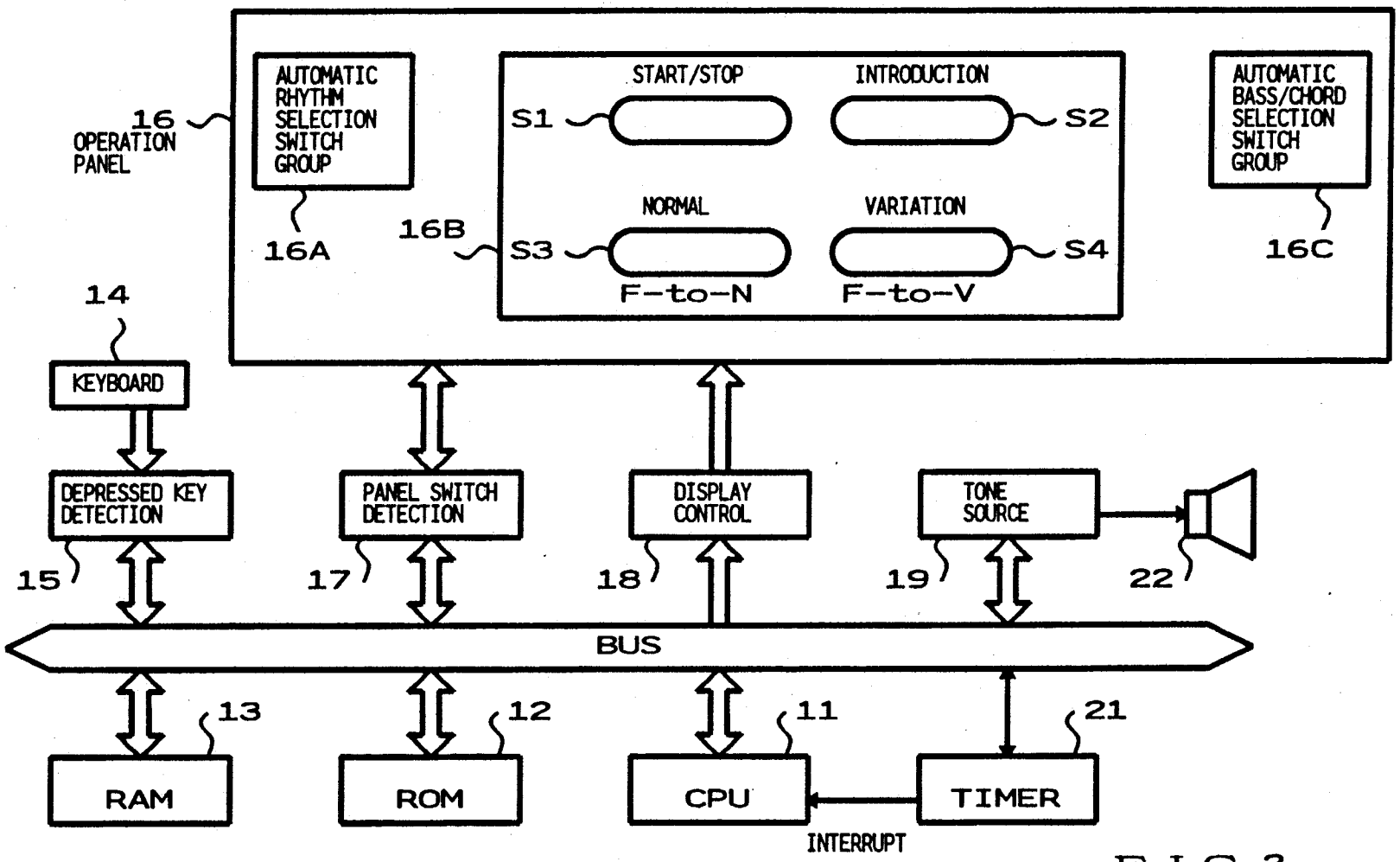
FIG. 2 is a block diagram showing a hardware structure of an embodiment of the automatic performance device according to the invention applied to an electronic musical instrument.

FIG. 2 is a block diagram showing a hardware structure of an electronic musical instrument incorporating the automatic performance device according to the invention. In this embodiment, various processing is performed under the control of a microcomputer including a central processing unit (CPU) 11, a ROM 12 and a RAM 13. The ROM 12 includes a program memory and various data memories and also various automatic performance pattern memories including a rhythm pattern memory and an automatic bass/chord pattern memory. The RAM 13 functions as a data and working memory and stores a part of various automatic performance patterns.

A keyboard 14 has plural keys for designating tone pitches of tones to be generated and key switches corresponding to the respective keys. A depressed key detection circuit 15 detects depression and release of the keys in the keyboard 14. The depressed key detection circuit 15 is connected to the microcomputer and supplies depressed key information and released key information to the microcomputer.

An operation panel 16 includes operators for selecting, setting or controlling tone color, tone volume, tone pitch and effects of tones and selection switches and control switches for the automatic performance. For example, the operation panel 16 includes an automatic rhythm selection switch group 16A for selecting various rhythms, a control switch group 16B for controlling the automatic rhythm and an automatic bass/chord selection switch group 16C for selecting the automatic bass/chord performance.

By way of an example, the control switch group 16B includes a start/stop switch S1 for controlling start and stop of the automatic rhythm, a switch S2 for performing the introduction performance or the ending performance instruction, a switch S3 for performing selection of the normal pattern or "fill-in-to-variation" designation and a switch S4 for performing selection of the variation pattern or "fill-in-to-variation" designation. In this embodiment, each of these switches S1–S4 is respectively used commonly for performing two control functions and one of the two control functions becomes valid depending upon whether or not a rhythm RUN state (i.e., a state where the automatic rhythm is being performed) exists.

In a non-rhythm RUN state (i.e., a state where the automatic rhythm is not being performed), the switch S1 functions as a rhythm start switch, the switch S2 as an introduction performance instruction switch, the switch S3 as a switch for selecting the normal pattern and the switch S4 as a switch for selecting the variation pattern.

In the rhythm RUN state in which the automatic rhythm is being performed, the switch S1 functions as a rhythm stop switch, the switch S2 as an ending performance instruction switch, the switch S3 as a switch for performing "fill-in-to-normal" instruction and the switch S4 as a switch for performing "fill-in-to-variation" designation.

A panel switch detection circuit 17 detects operation states and on/off states of the various operators and switches in the operation panel 16. The circuit 17 is connected to the microcomputer and supplies operation information and on/off information of these operators and switches to the microcomputer. A display control circuit 18 controls display operations of display devices provided in the operation panel 16 and is connected to the microcomputer.

A tone source circuit 19 has a tone source circuit for scale tones and a rhythm tone source circuit and thereby is capable of producing tone signals of scale tones and rhythm tones in plural channels. Any known or unknown tone source circuit may be employed as the tone source circuit 19. Information (including set information of tone pitch, tone color and tone volume) representing a scale tone or a rhythm tone to be generated in the respective channels or rhythm tone source is supplied to the tone source circuit 19 and a tone signal of a scale tone or rhythm tone is generated on the basis of this information. The tone signal generated by the tone source circuit 19 is supplied to a sound system 20 and propagated therefrom as an audio acoustic signal.

A timer 21 forms a predetermined tempo clock signal in accordance with a variably determined performance tempo and this tempo clock signal constitutes an interrupt signal to the CPU 11. For example, this tempo signal, i.e., interrupt signal, is generated at each tempo timing which is provided by dividing one bar by 96. In the case of four-four time, 24 interrupt timings (24 tempo clocks) correspond to the length of a crotchet.

An embodiment of the invention which has been applied to automatic rhythm performance in an electronic musical instrument shown in FIG. 2 will now be described.

Figure 3:
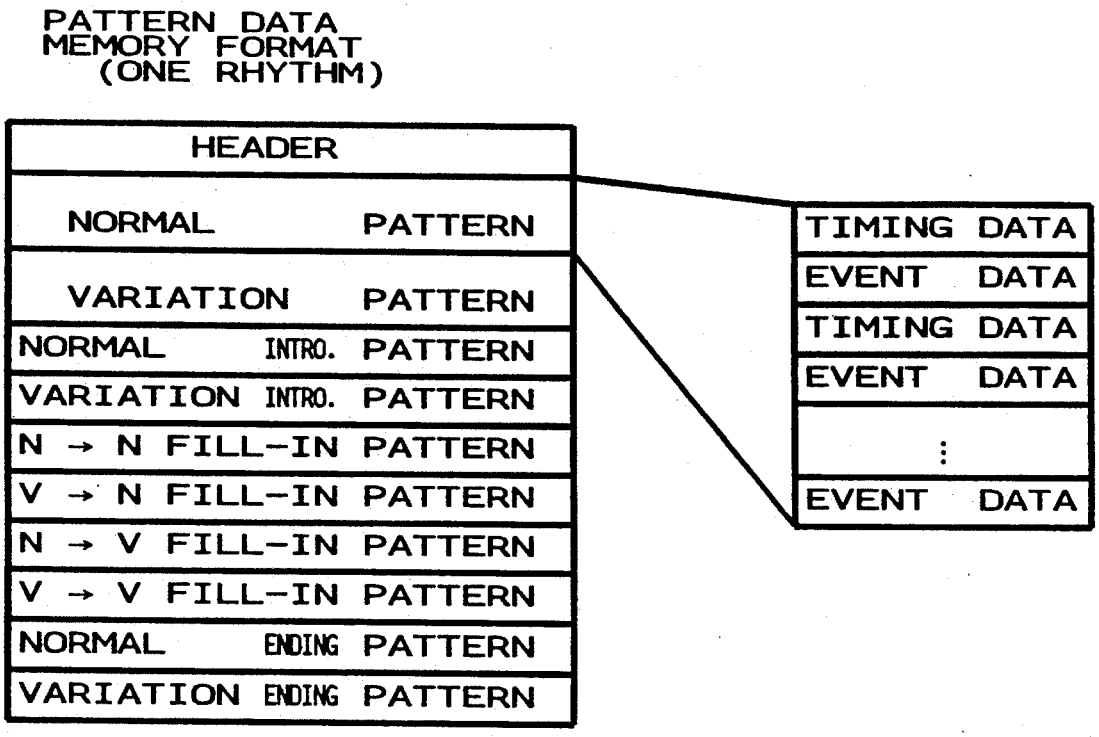
FIG. 3 is a diagram showing an example of a memory format of a rhythm pattern memory.

Referring first to FIG. 3, an example of memory format of a rhythm pattern memory included in the ROM 12 will be described. The memory format shown in FIG. 3 corresponds to one rhythm name which can be selected by the automatic rhythm selection switch group 16A. It may therefore be understood that a rhythm pattern data group consisting of a format as shown in FIG. 3 is provided for each rhythm name which can be selected by the automatic rhythm selection switch group 16A.

In the rhythm pattern memory, a plurality of rhythm performance patterns are stored for one rhythm name. Types of these rhythm performance patterns are the same as those shown in FIG. 1, i.e., two types of main patterns (normal patterna and variation pattern), four types of fill-in patterns (N→N fill-in pattern, V→N fill-in pattern, N→V fill-in pattern, V→N fill-in pattern) and two types of ending patterns (normal ending pattern and variation ending pattern).

There is a header section preceding a memory area for each rhythm performance pattern. In the header section, data representing a head address of a memory area of each pattern and various set data which are common to the particular rhythm name are stored.

The respective patterns are arranged in such a manner that the order of addresses corresponds to the order of performance, so that timing data and event data are stored at sequential addresses in the order of performance. Timing data is stored prior to event data and this timing data represents a timing at which the event should be generated. In this example, the timing data indicates the timing at which the event should be generated by the number of the tempo clocks (times of interrupt timings) from the beginning of one bar till generation of the event. In this example, the event data consists of note on-event data (various data necessary for designating generation of one tone). More specifically, the note on-event data consists of note number, velocity data and gate time data. In the case of a rhythm tone, the note number designates the type of a percussion instrument tone to be generated. The note number may include data designating pitch of the percussion instrument tone. The velocity data is data designating strength of tone (tone volume) concerning the particular event. The gate data is data representing length of key-on time concerning the particular event. Last event data in the pattern includes a predetermined end code.

An example of processing executed by the microcomputer will now be described with respect mainly to processing of automatic rhythm performance and with reference to flow charts. According to these flow charts, the pattern change shown in FIG. 1 can be substantially realized.

Description of the main routine

Figure 4:
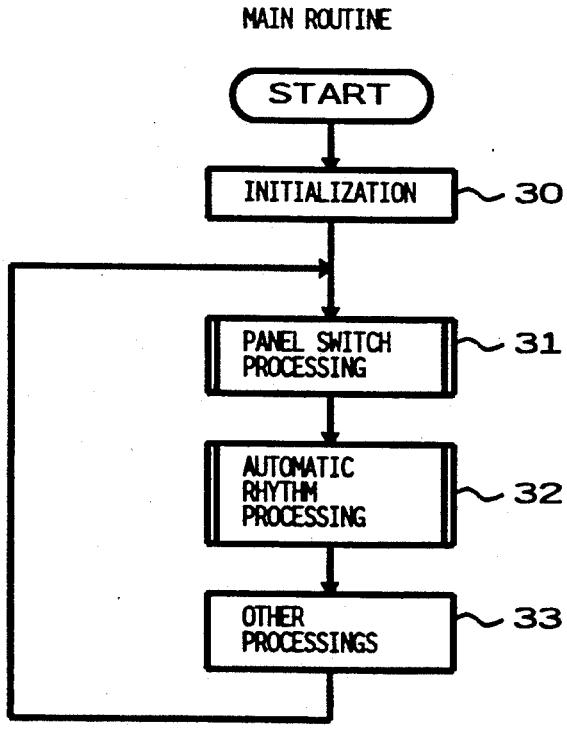
FIG. 4 is a flow chart showing an example of a main routine executed by a microcomputer in FIG. 2.

FIG. 4 shows an example of the main routine. After a predetermined initializing processing (step 30), a panel switch processing (step 31), an automatic rhythm processing (step 32) and other processings (step 33) are repeatedly executed.

In the panel switch processing (step 31), the operators and switches in the operation panel 16 are scanned to detect their on/off states and various processing is carried out in response to the detection. An example of processing concerning the automatic rhythm among the various processing executed in the panel switch processing, i.e., processing concerning the automatic rhythm selection switch group 16A and the control switch group 16B is extracted and shown in FIGS. 5 through 8. FIGS. 5 through 8 show a series of processing which is connected at points designated by the same reference characters A, B and C used for representing connection of processing.

Figure 9:
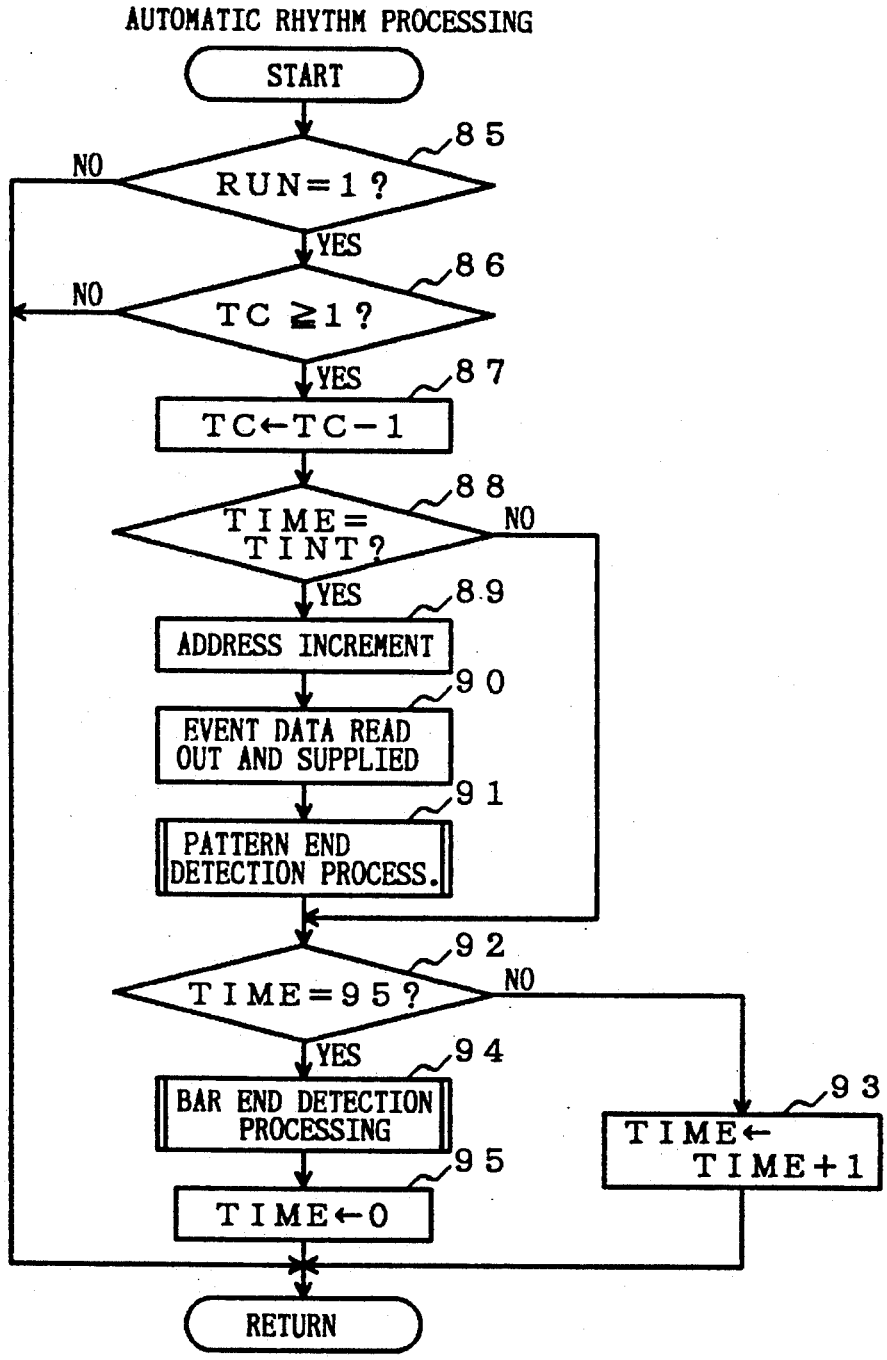
FIG. 9 is a flow chart showing a specific example of an automatic rhythm processing in FIG. 4.
Figure 10:
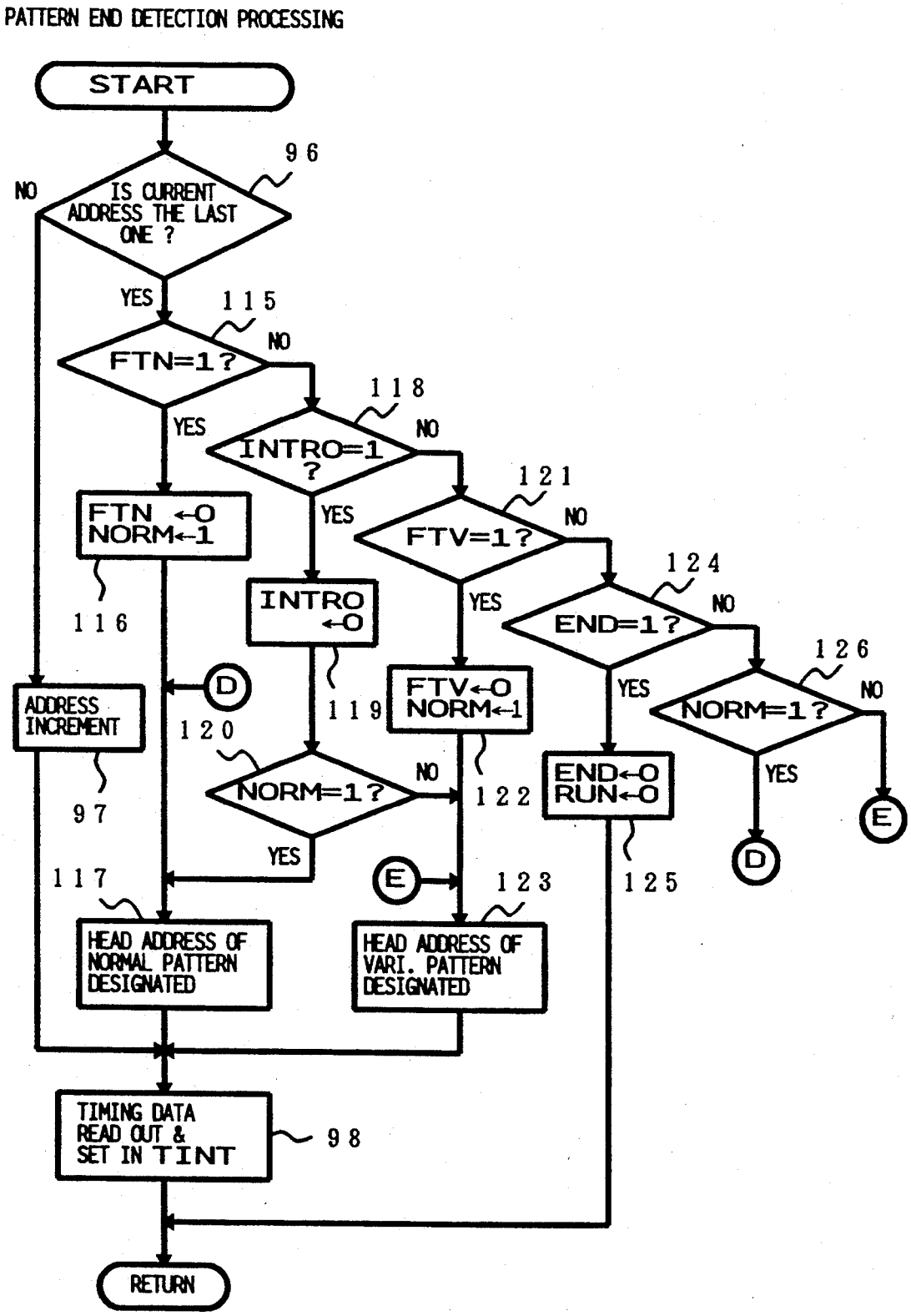
FIG. 10 is a flow chart showing a specific example of a pattern end detection processing in FIG. 9.
Figure 11:
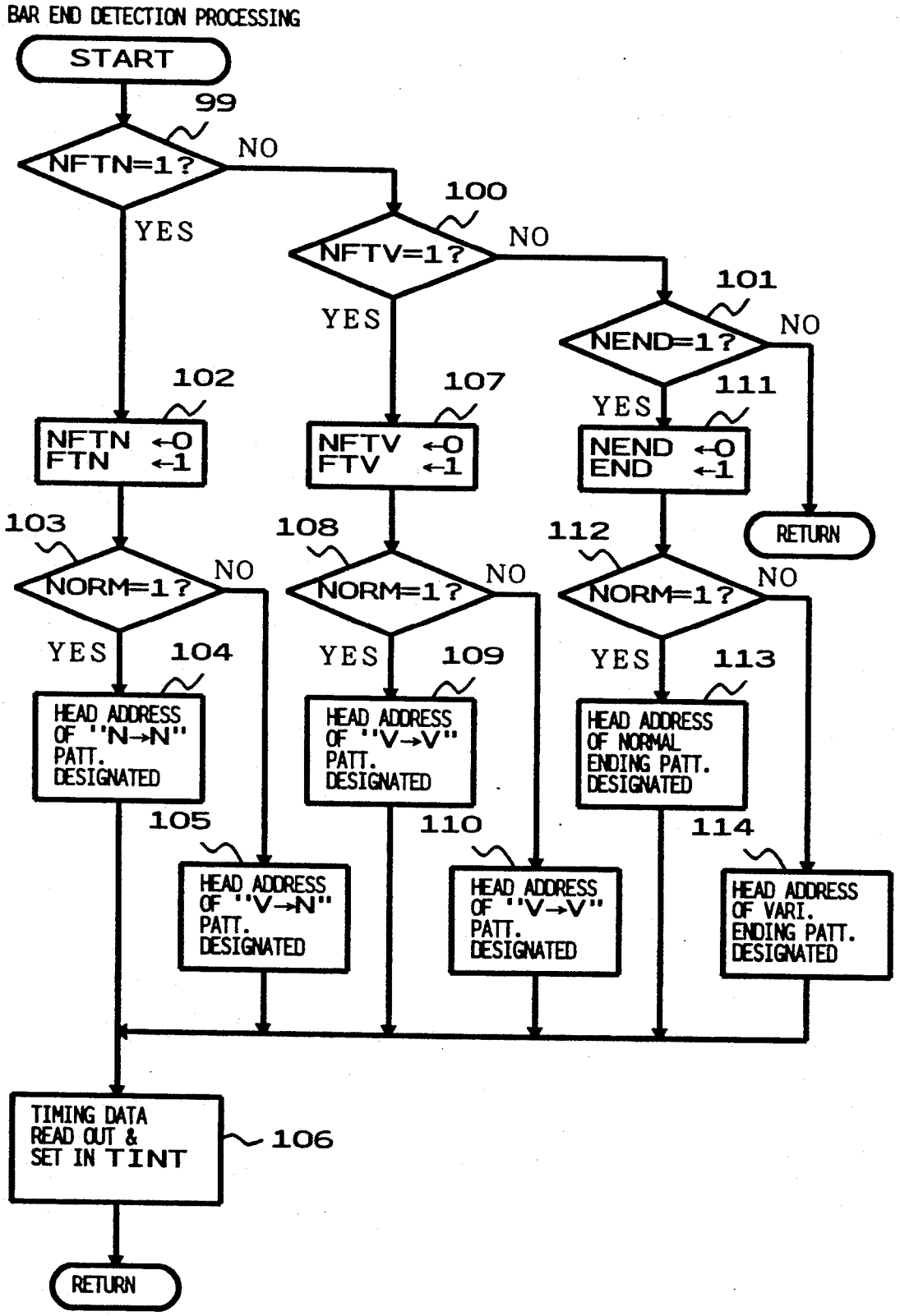
FIG. 11 is a flow chart showing a specific example of a bar end detection processing in FIG. 9.

In the automatic rhythm processing (step 32), a processing for carrying out the automatic rhythm performance is executed in response to interruption of the tempo clock signal. An example of this processing is shown in FIGS. 9 through 11.

In the other processings (step 33), various other processings such as depressed key detection and released key detection are executed.

Description of interrupt processing

Figure 12:
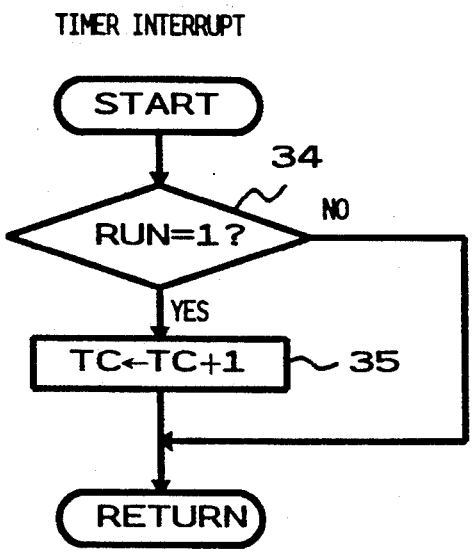
FIG. 12 is a flow chart showing a specific example of a timer interrupt processing executed in response to a tempo clock signal.

When a tempo clock signal is generated from the timer 21 during execution of the main routine and interruption is thereby made to the CPU 11, a timer interrupt processing shown in FIG. 12 is executed. In this timer interrupt processing, whether or not a RUN flag (which is set to "1" in the automatic rhythm RUN state and otherwise is set to "0") is "1" is examined (step 34). When step 34 is YES, the value of a tempo clock register TC is increased by 1 (step 35) and the processing is ended. When step 34 is NO, i.e., the rhythm RUN state does not exist, the processing is ended immediately. The tempo clock register TC indicates the number of unprocessed tempo clock interrupt. In actual interrupt processing, the interrupt processing is simplified by performing only increase of the register TC and a virtual automatic rhythm performance execution processing in response to this interrupt signal is made in the automatic rhythm performance processing (step 32) in the main routine whereby the burden on the CPU 11 is alleviated. Accordingly, as will become apparent later, the virtual automatic rhythm performance execution processing is carried out in accordance with the value of the tempo clock register TC.

Rhythm selection

Figure 5:
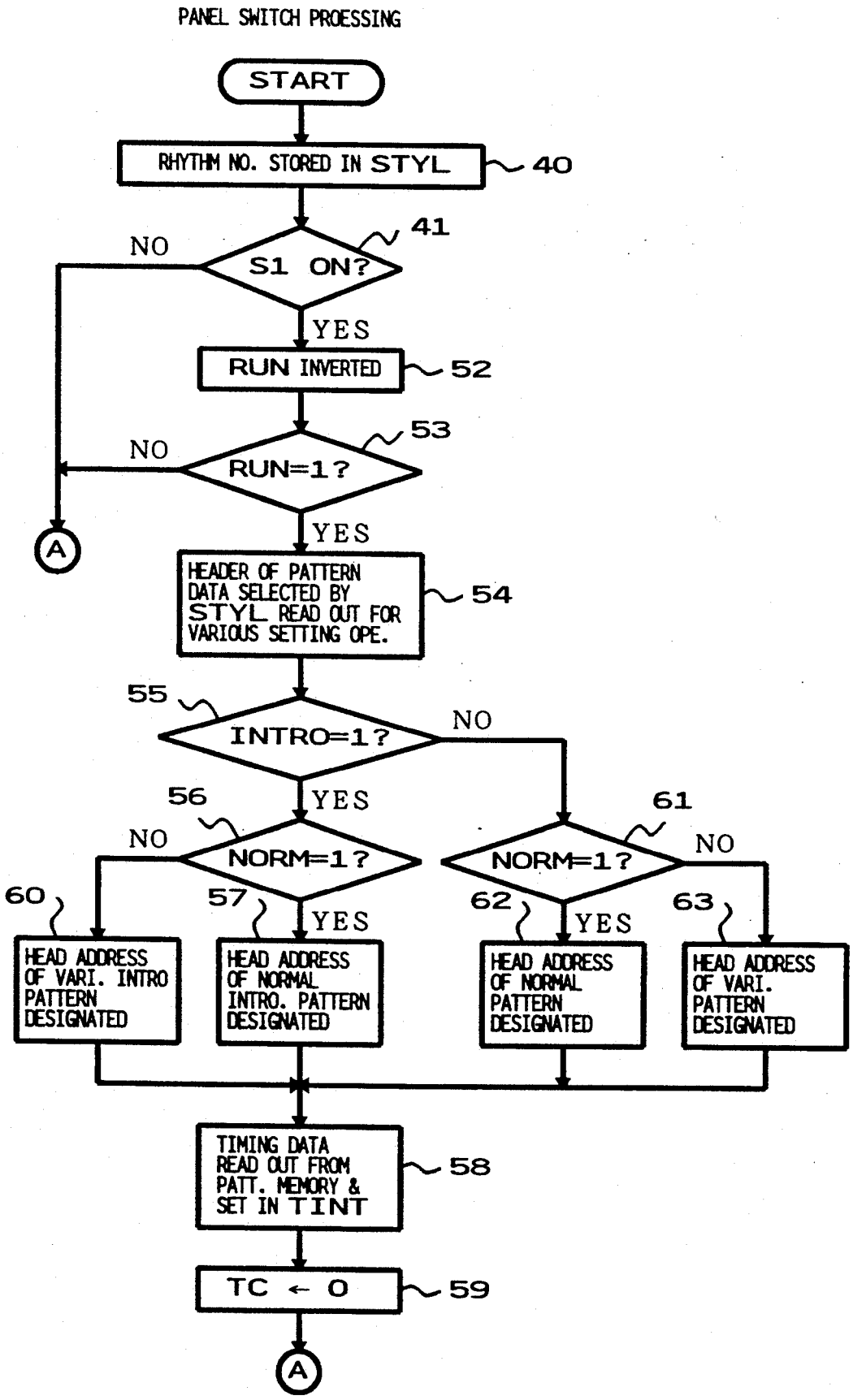
FIG. 5 is a flow chart showing an example of processing executed in a panel switch processing in FIG. 4.

When an operation for selecting a desired rhythm name has been made by the automatic rhythm selection switch group 16A, a rhythm style number corresponding to the selected rhythm name is stored in a rhythm style register STYL in step 40 of FIG. 5. As will be described later, in response to the rhythm style number stored in this rhythm style register STYL, a rhythm pattern data group in the ROM 12 corresponding to one rhythm name is selected.

Selection of the main pattern

As has been previously described, by turning on the switch S3 or S4 in the control switch group 16B in the state where the automatic RUN does not exist, the normal pattern or variation pattern can be selected.

A case where the switch S3 has been turned on to select the normal pattern will be described first. In FIG. 5, after processing of the above described step 40, the routine proceeds to step 41 where whether or not the switch S1, i.e., the rhythm start/stop switch, is on or not is examined. In the present case, step 41 is NO and the routine proceeds to step 43 of FIG. 7. In step 43, whether the switch S3, i.e., the switch for selecting the normal pattern or performing "fill-in-to-normal" designation, is on or not is examined. In the present case, the switch S3 is on so that step 43 is YES and the routine proceeds to step 44. In step 44, whether the RUN flag is "1" or not is examined. In this case, the automatic rhythm RUN state does not exist and, therefore, step 44 is NO. This indicates that the switch S3 is functioning as the normal pattern selection switch. When step 44 is NO, the routine proceeds to step 45 where a normal pattern flag NORM is set to "1". Thereafter, the routine proceeds to step 46 of FIG. 8 where whether the switch S4 is on is or not examined. In the present case, step 45 is NO and, therefore, the routine proceeds to step 47 where other processing is executed. Thereafter the routine returns. Thus, when the normal pattern has been selected, the normal pattern flag NORM is set to "1". As will be described later, when the "fill-in-to-normal" designation has been given during the automatic performance and the pattern is shifted to the normal pattern after the fill-in performance, the normal pattern flag is also set to "1".

A case where the switch S4 has been turned on to select the variation pattern will now be described. In this case, the routine proceeds through NO of step 41, No of step 42 and No of step 43 described above to step 46 of FIG. 8. In step 46, whether the switch S4, i.e., the switch for selecting the variation pattern or performing the "fill-in-to-variation" pattern is on or not is examined. In the present case, the switch S4 is on and, therefore, step 46 is YES and the routine proceeds to step 48. In step 48, whether the RUN flag is "1" or not is examined. In the present case, the automatic rhythm RUN state does not exist and, therefore, step 48 is NO. This indicates that the switch S4 is functioning as the variation selection switch. When step 48 is NO, the processing proceeds to step 49 where the normal pattern flag NORM is reset to "0". Thereafter, the routine proceeds to step 47 where other processing is executed and then the routine returns. Thus, when the variation pattern has been selected, the normal pattern flag NORM is reset to "0". As will be described later, when the "fill-in-to-variation" designation has been made during the automatic performance and the pattern has been shifted to the variation after the fill-in performance, the normal pattern flag NORM is reset also to "0".

Automatic selection of the introduction pattern

By turning on the switch S2 of the control switch group 16B when the automatic rhythm RUN state does not exist, the introduction performance is designated.

Figure 6:
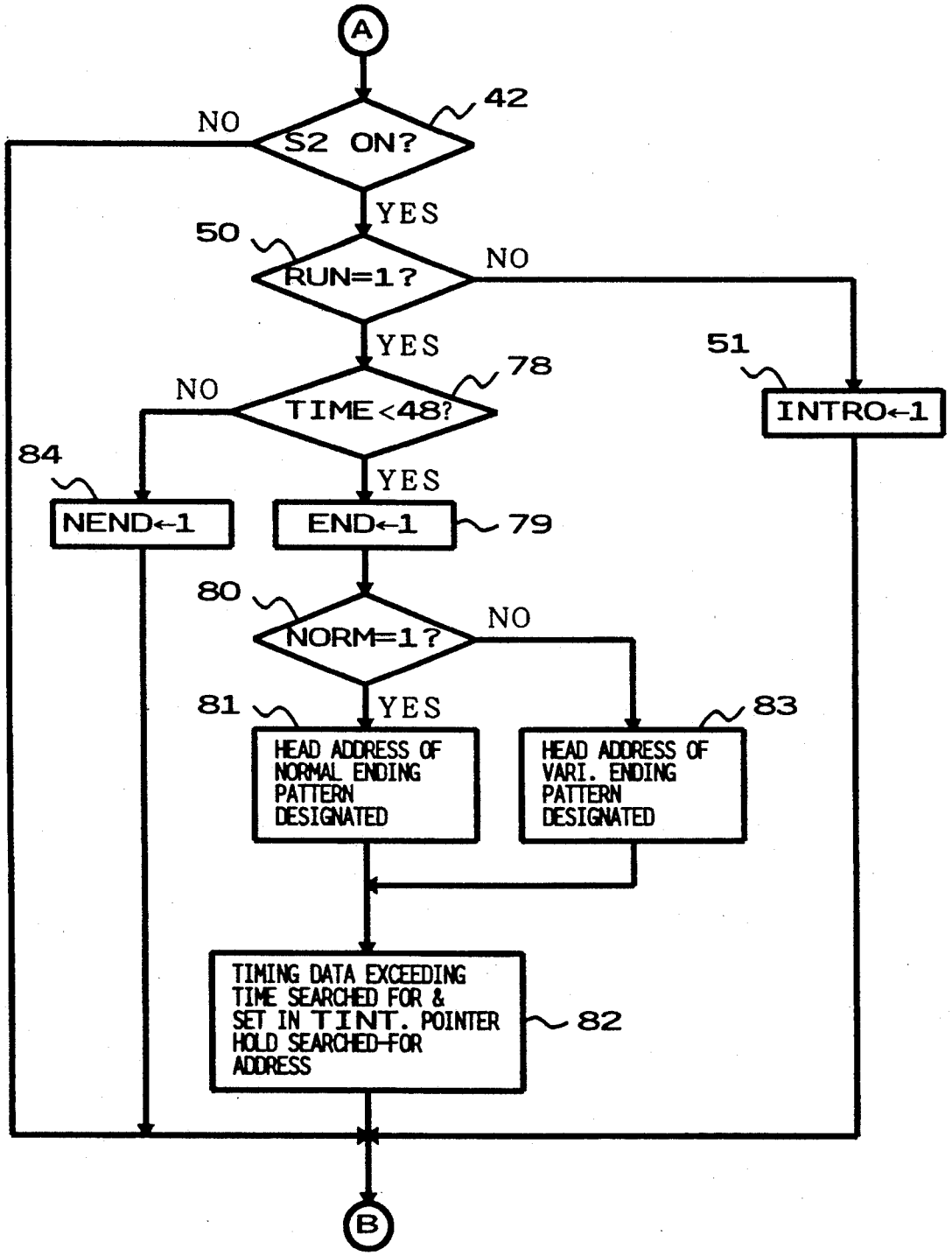
FIG. 6 is a flow chart showing another example of processing executed in the panel switch processing in FIG. 4 with respect to a portion which is executed subsequent to the flow chart of FIG. 5.

In FIG. 5, the above described step 40 is NO and the routine proceeds to step 42 of FIG. 6. Since in the present case the switch S2 is on, step 42 is YES and the routine proceeds to step 50. In step 50, whether or not the RUN flag is "1" is examined. In the present case, the automatic rhythm RUN state does not exist and, therefore, step 50 is NO. This indicates that the switch S2 is functioning as the switch introduction performance instruction switch. When step 50 is NO, the routine proceeds to step 51 where an introduction flag INTRO is set to "1". Thereafter, the routine proceeds to step 43 of FIG. 7 and then returns from NO of step 43 through NO of step 46 in FIG. 8. When the introduction performance has been instructed in this manner, the introduction flag INTRO is set to "1".

For starting performance, the switch S1 of the control switch group 16B is turned on. In response thereto, YES judgement is made in step 41 of FIG. 5 and the routine proceeds to step 52. In step 52, the RUN flag is inverted. In the present case, the RUN flag which has been "0" is now turned to "1" by the inversion. That is, the switch S1 functions as the rhythm start switch. In next step 53, whether or not the RUN flag is "1" is examined. In the present case, step 53 is YES and the routine proceeds to step 54. In step 54, a rhythm pattern data group in the ROM 12 corresponding to the selected rhythm is selected in response to the rhythm style number in the rhythm style register STYL and various data stored in the header section of this rhythm pattern data group is read out. Various setting operations are executed in response to the read out data.

In step 55, whether or not the introduction flag INTRO is "1" is examined. In the present case, the introduction flag INTRO is set to "1" and, therefore, step 55 is YES and the routine proceeds to step 56. In step 56, whether the normal pattern flag NORM is "1" or not is examined. When the normal pattern has been selected as the main pattern, this flag NORM is "1", so that a judgement of YES is made in step 56 and the routine proceeds to step 57. In step 57, the head address of the normal introduction pattern in the rhythm pattern data group stored in the ROM 12 corresponding to the selected rhythm is designated. This brings about a mode in which reading of the normal introduction pattern from the rhythm pattern memory is started. Thus, the normal introduction pattern is automatically selected. The processing in this part corresponds to the processing shown by the route of reference character 3 in FIG. 1.

In next step 58, timing data is read from the designated head address and set in a time interval register TINT. In next step 59, the tempo clock register TC is reset to the initial value 0. Thus, the register TC is reset in synchronism with starting of the automatic performance. After step 59, the routine proceeds to step 42 of FIG. 6 and finally returns through step 47 of FIG. 8. Subsequent stepping of the address is performed in the automatic rhythm processing of FIG. 9 as will be described more fully later.

Reverting to step 56 of FIG. 5, description will now be made about a case where the variation pattern has been selected as the main pattern. In this case, the flag NORM is "0" and step 56 is judged NO and the routine proceeds to step 60. In step 60, the head address of the variation introduction pattern in the rhythm pattern data group of the ROM 12 corresponding to the selected rhythm is designated. This brings about a mode in which reading of the variation pattern from the rhythm pattern memory is started. Thus, the variation introduction pattern is automatically selected. The processing of this part corresponds to the processing of the route 4 in FIG. 1. Thereafter, the routine proceeds to step 58 and the same processing as described above is executed.

A case where no introduction performance is inserted

In a case where the switch S1 of the control switch group 16B has been turned on without designating the introduction performance, the processing of steps 41, 52, 53 and 54 in FIG. 5 is executed in the same manner as described above and then the routine proceeds to step 55. Since the introduction performance is not designated in the present case, the introduction flag INTRO is "0" and step 55 is NO. The routine then proceeds to step 61. In step 61, whether the normal pattern flag NORM is "1" or not is examined. When the normal pattern has been selected as the main pattern, this flag NORM is "1" and a judgement of YES is made in step 61 and the routine proceeds to step 62. In step 62, the head address of the normal pattern in the rhythm pattern data group in the ROM 12 corresponding to the selected rhythm is designated. This brings about a mode in which reading of the normal pattern from the rhythm pattern memory is started. The processing of this part corresponds to the processing of the route shown by reference character 1 in FIG. 1. Thereafter, the routine proceeds to step 58 in which the same processing as described above is executed.

In a case where the variation pattern has been selected as the main pattern, the flag NORM is "0" and a judgement of NO is made in step 61 and the routine proceeds to step 63. In step 63, the head address of the variation pattern in the rhythm pattern data group in the ROM 12 corresponding to the selected rhythm is designated. This brings about a mode in which reading of the variation pattern from the rhythm pattern memory is started. The processing of this part corresponds to the processing of the route designated by reference character 2. Then the routine proceeds to step 58 where the same processing as described above is executed.

Automatic selection of the fill-in pattern

As described previously, by turning on the switch S3 or S4 of the control switch group 16B in the automatic rhythm RUN state, the "fill-in-to-normal" designation or the "fill-in-to-variation" designation can be made.

Description will be made first about a case where the switch S3 has been turned on to make the "fill-in-to-normal" designation. In response to turning on of the switch S3, step 43 of FIG. 3 becomes YES and the routine proceeds to next step 44. Since the automatic rhythm RUN state exists in this instance, the RUN flag is "1" and a judgement of YES is made in step 44. This indicates that the switch S3 is functioning as the "fill-in-to-normal" designation switch. When step 44 is YES, the routine proceeds to step 64 in which whether or not the value of the tempo timing register TIME is smaller than "72" is examined.

As will become apparent later, the value of the tempo timing register TIME indicates the tempo timing which is currently executed in the automatic performance pattern. This value repeats incremental change with a resolution of the tempo clock interrupt signal and at a modulo of one bar, i.e., within a range of 0–95. When, therefore, the value of this register TIME is smaller than "72", it indicates that the current tone generation timing has not reached the fourth beat of one bar yet. In other words, in the case of four-four time, 0–23 corresponds to the second beat, 48–71 corresponds to the third beat and 72–95 corresponds to the fourth beat.

After all, in step 64, whether or not the performance of the main pattern to the current time point has reached the fourth beat of one bar is examined when the "fill-in-to-normal" designation has been made. This arrangement is made for performing a control in such a manner that, when the performance of the main pattern to the current time point has not reached the fourth beat of one bar yet, the fill-in performance will be inserted in the main pattern (in this case, the fill-in pattern begins from midway of that bar) whereas, when the performance of the main pattern to the current time point has reached the fourth beat of one bar, the fill-in pattern will not be inserted until the bar of the main pattern has ended but will be inserted from the beginning of next bar (in this case, the fill-in pattern starts from the beginning of the bar). The performance of a proper control made when the performance pattern is changed in the middle of a bar is beneficial because it enables a natural switching of the performance pattern to be realized.

Figure 7:
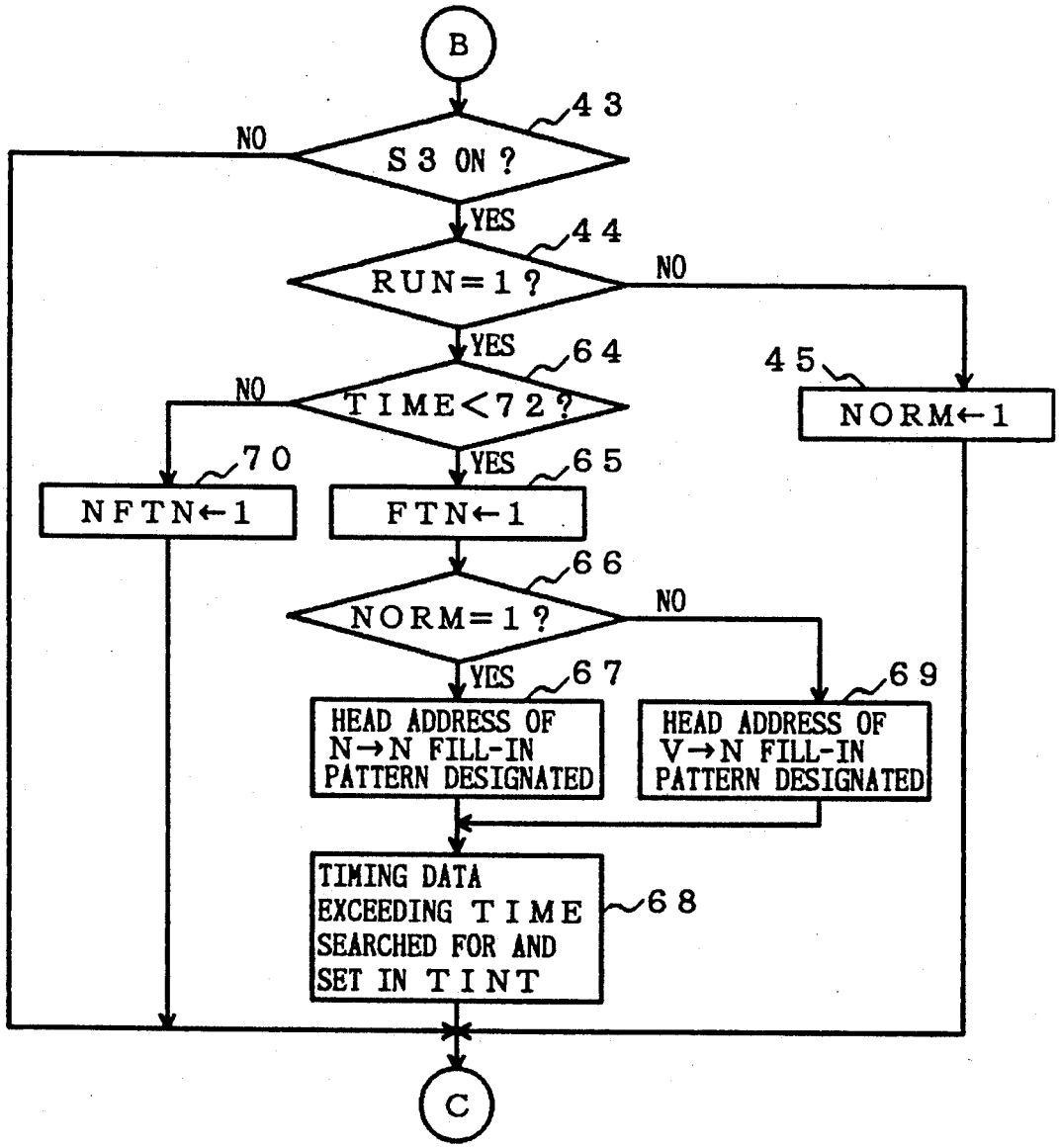
FIG. 7 is a flow chart showing another example of processing executed in the panel switch processing in FIG. 4 with respect to a portion which is executed subsequent to the flow chart of FIG. 6.

When the value of the tempo timing register TIME is smaller than "72", step 64 in FIG. 7 is YES and the routine proceeds to step 65 where a fill-in-to-normal flag FTN is set to "1" . The value "1" of the flag FTN indicates that the fill-in performance should be immediately made and thereafter the pattern should be shifted to the normal pattern.

In this case, the performance of the main pattern made to this time point has not reached the fourth beat of one bar yet and, therefore, processing for inserting the fill-in performance in the main pattern (in this case, the fill-in performance is started from midway of the bar) is executed in the subsequent steps 66, 67 and 68.

In step 66, whether or not the normal pattern flag NORM is "1" is examined. When the pattern which was performed immediately before the fill-in performance is the normal pattern, this flag NORM is "1" and the routine proceeds to step 67. In step 67, the head address of the "N→N fill-in pattern" in the rhythm pattern data group in the ROM 12 corresponding to the selected rhythm is designated. This brings about a mode in which reading of the N→N fill-in pattern from the rhythm pattern memory is started. Thus, the "N→N fill-in pattern" is automatically selected on the basis of the relation of the performance pattern before and after the fill-in performance. The processing of this part corresponds to the processing of the route designated by reference character 5a.

In next step 68, an address pointer is sequentially incremented from the head address designated in the preceding step to sequentially read out the timing data in the fill-in pattern. The value of this timing data is compared with the current value of the tempo timing register TIME and the address pointer is stopped at an address at which the value of the timing data has exceeded the value of the tempo timing register TIME. Then the value of the timing data is set in the time interval register TINT. The contents of the time interval register TINT indicate next tone generation timing. Accordingly, by searching the value of the timing data which has just exceeded the value of TIME and setting this value in the register TINT, the fill-in performance can be started from midway of a bar at a tempo timing matching the tempo timing of the main pattern which is interrupted at midway of the bar.

When the pattern which was performed immediately before the fill-in performance was the variation pattern, the flag NORM is "0" and, therefore, step 66 is NO and the routine proceeds to step 69. In step 69, the head address of the "V→N fill-in pattern" in the rhythm pattern data group in the ROM 12 corresponding to the selected rhythm is designated. This brings about a mode in which reading of the V→N fill-in pattern from the rhythm pattern memory is started. Thus, the "V→N fill-in pattern" is automatically selected on the basis of the relation of the performance pattern before and after the fill-in performance. The processing of this part corresponds to the processing of the route designated by reference character 6a in FIG. 1. Thereafter, the processing of step 68 is executed in the same manner as described above.

When the value of the tempo timing register TIME is "72" or over, step 64 in FIG. 7 is NO and the routine proceeds to step 70 where a next fill-in-to-normal flag NFTN is set to "1". The value "1" of this flag NFTN indicates that the fill-in performance should be executed from the beginning of next bar and thereafter the performance should be shifted to one according to the normal pattern.

In this case, the performance of the main pattern made to this time point has reached the fourth beat of one bar and, therefore, processing for performing a control in such a manner that the fill-in pattern is not inserted until the bar of the main pattern is ended but is inserted from the beginning of next bar (in this case, the fill-in performance is started from the beginning of the bar) is made by a bar end detection processing in the automatic rhythm processing of FIG. 9 (a specific example thereof is shown in FIG. 11).

Description will now be made about a case where the switch S4 is turned on to make the "fill-in-to-variation" designation. In response to turning on of the switch S4, step 46 of FIG. 8 becomes YES and the routine proceeds to next step 48. In this instance, the automatic rhythm RUN state exists and, therefore, the RUN flag is "1" and a judgement of YES is made in step 48. This indicates that the switch S4 is functioning as the "fill-in-to-variation" designation switch. When step 48 is YES, the routine proceeds to step 71 and, in the same manner as in step 64 and for the same reason as in step 64, whether or not the value of the tempo timing register TIME is smaller than "72" is examined.

When the value of the tempo timing register TIME is smaller than "72", processing of steps 72–75 which is similar to the processing in steps 65–68 in FIG. 7 is executed. In step 72, a fill-in-to-variation flag FTV is set to "1". The value "1" of the flag FTV indicates that the fill-in performance should be immediately made and thereafter the performance should be shifted to one according to the variation pattern. In next step 73, whether the normal pattern flag NORM is "1" or not is examined. When the pattern which was performed immediately before the fill-in performance is the normal pattern, this flag NORM is "1" and the routine proceeds to step 74. In step 74, the head address of the "N→V fill-in pattern" in the rhythm pattern data group in the ROM 12 corresponding to the selected rhythm is designated. This brings about a mode in which reading of the N→V fill-in pattern from the rhythm pattern memory is started. Thus, the "N→V fill-in pattern" is automatically selected. The processing of this part corresponds to the processing of the route designated by reference character 7*a* in FIG. 1. Processing in next step 75 is the same as the processing in step 68 in FIG. 7.

When the pattern which was performed immediately before the fill-in performance was the variation pattern, the flag NORM is "0" and, therefore, the above step 73 is NO and the routine proceeds to step 76. In step 76, the head address of the "V→V fill-in pattern" in the rhythm pattern data group in the ROM 12 corresponding to the selected rhythm is designated. This brings about a mode in which reading of the V→V fill-in pattern from the rhythm pattern memory is started. Thus, the "V→V fill-in pattern" is automatically selected on the basis of the relation of the performance pattern before and after the fill-in performance. The processing of this part corresponds to the processing of the route designated by reference character 8*a* in FIG. 1. Then, the processing of step 75 is executed in the same manner as described above.

Figure 8:
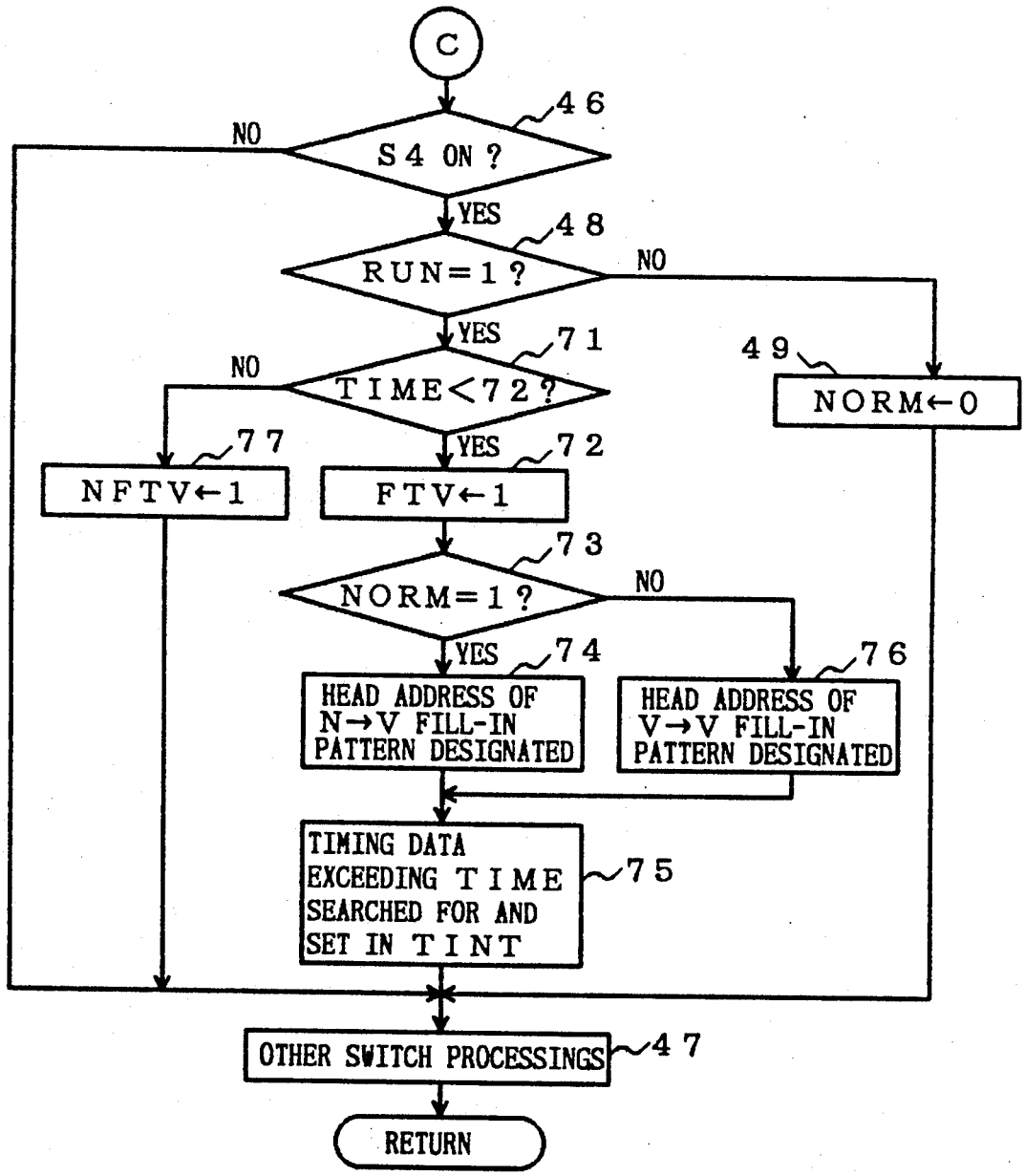
FIG. 8 is a flow chart showing another example of processing executed in the panel switch processing in FIG. 4 with respect to a portion which is executed subsequent to the flow chart of FIG. 7.

In the same manner as described above, when the value of the tempo timing register TIME is "72" or over, step 71 of FIG. 8 is NO and the routine proceeds to step 77 where a next fill-in-to-variation flag NFTV is set to "1". The value "1" of this flag NFTV indicates that the fill-in performance should be made from the beginning of next bar and thereafter the performance should be shifted to one according to the variation pattern.

Automatic selection of the ending pattern

As described previously, by turning on the switch S2 of the control switch group 16B in the automatic rhythm RUN state, the ending performance instruction can be performed.

In response to turning on of the switch S2, step 42 of FIG. 6 becomes YES and the routine proceeds to next step 50. In the present case, the automatic rhythm RUN state exists and, therefore, the RUN flag is "1" and a judgement of YES is made in step 50. This indicates that the switch S2 is functioning as the ending performance instruction switch. When step 50 is YES, the routine proceeds to step 78 where whether or not the value of the tempo timing register TIME is smaller than "48" is examined.

The value of the tempo timing register TIME which is smaller than "48" indicates that the current tone generation timing has not reached midway of one bar yet. In step 78, therefore, whether the main pattern which has been performed so far has reached midway of one bar or not is examined. This arrangement is made for performing a control in such a manner that, when the performance of the main pattern to the current time point has not reached midway of one bar, the ending performance will be inserted in the main pattern (in this case, the ending performance starts from midway of the bar) whereas, when the performance of the main pattern to the current time point has reached midway of one bar, the ending pattern will not be inserted until the bar of the main pattern has ended but will be inserted from the beginning of next bar (in this case, the ending pattern starts from the beginning of the bar). As described previously, the performance of a proper control made when the performance pattern is changed in the middle of a bar is beneficial because it enables a natural switching of the performance pattern to be realized. The midway position at which the change of the pattern occurs is made different between the fill-in pattern and the ending pattern because this position may be determined properly in accordance with the characteristic of each performance.

When the value of the tempo timing register TIME is smaller than "48", step 78 of FIG. 6 is YES and the routine proceeds to step 79 where an ending flag END is set to "1". The value "1" of this flag indicates that the ending performance should be immediately executed.

In this case, since the performance of the main pattern to the current point has not reached midway of one bar yet, a processing for inserting the ending performance in the main pattern (in this case, the ending performance is started from midway of the bar) is executed in subsequent steps 80, 81 and 82.

In step 80, whether the normal pattern flag NORM is "1" or not is examined. When the pattern performed immediately before the ending performance instruction was the normal pattern, this flag NORM is "1" and the routine proceeds to step 81. In step 81, the head address of the normal ending pattern in the rhythm pattern data group in the ROM 12 corresponding to the selected rhythm is designated. This brings about a mode in which reading of the normal ending pattern from the rhythm pattern memory is started. Thus, the normal ending pattern is automatically selected in accordance with the performance pattern made immediately before the ending designation. The processing of this part corresponds to the processing of the route designated by reference character 9 in FIG. 1. Processing of next step 82 is the same processing as in step 68 of FIG. 7.

When the pattern made immediately before the ending designation was the variation pattern, the flag NORM is "0" and, therefore, the above described step 80 is NO and the routine proceeds to step 83. In step 83, the head address of the variation ending pattern in the rhythm pattern data group in the ROM 12 corresponding to the selected rhythm is designated. This brings about a mode in which reading of the variation ending pattern from the rhythm pattern memory is started. Thus, the variation ending pattern is automatically selected in accordance with the performance pattern immediately before the ending performance instruction. The processing of this part corresponds to the processing of the route designated by reference character 10 of FIG. 1. Thereafter, the processing of step 82 is executed in the same manner as described above.

When the value of the tempo timing register TIME is "48" or over, step 78 of FIG. 6 is NO and the routine proceeds to step 84 where a next ending flag NEND is set to "1". The value "1" of this flag NEND indicates that the ending performance should be started from the beginning of next bar.

Automatic rhythm tone generation processing

In the automatic rhythm processing shown in FIG. 9, whether the RUN flag is "1" or not is first examined (step 85). When step 85 is NO, the routine returns immediately. When step 85 is YES, the routine proceeds to step 86 where whether the value of the tempo clock register TC is 1 or over is examined. As described previously, the value of the tempo clock register TC represents the number of unprocessed interrupt clocks. Assume, for example, that an interrupt clock signal has been generated, the value of TC has become 1 by the processing of FIG. 12 and thereafter this automatic rhythm processing has started. Since step 86 is YES, processing of steps 87–95 is executed. In step 87, the value of TC is decreased by 1. In other words, when the processing of steps 87–95 has been made once, the value of TC is decreased by 1. This indicates that the processing of steps 87–95 is made once in response to generation of one interrupt clock signal. For example, in a case where time has been consumed for executing other processing in the main routine and two interrupt clock signals have been generated before the automatic rhythm processing shown in FIG. 9 is started, the value of TC is 2 and, therefore, the value of TC is still 1 when the processing of steps 87–95 has been completed once, so that the processing of steps 87–95 is performed once again. Thus, the processing of steps 87 can be executed accurately as many times as the number of the interrupt clock signals.

In step 88, the value of the tempo timing register TIME is compared with the value of the time interval register TINT to detect coincidence. As described previously, the value of the tempo timing register TIME represents the tempo timing which is being processed among tempo timings provided by dividing one bar by 96. On the other hand, the time interval register TINT stores timing data representing tempo timing in one bar of a next tone to be generated. When, therefore, the tempo timing of the next tone to be generated has arrived, the values of TIME and TINT coincide with each other and step 88 becomes YES. When the tempo timing of the next tone to be generated has not arrived yet, step 88 is NO and the routine proceeds to step 92.

In step 92, whether or not the value of the tempo timing register TIME is the maximum value 95, i.e., whether or not the tempo timing under processing is the last one of one bar or not, is examined. When step 92 is NO, the routine proceeds to step 93 where the value of TIME is increased by 1 and then the routine returns. In this manner, the processing of step 87 and subsequent steps in FIG. 9 is executed and the value of TIME is increased by 1 in response to generation of the interrupt clock signal.

Upon arrival of the tempo timing of a next tone to be generated, the coincidence TIME=TINT is achieved so that step 88 becomes YES and the routine proceeds to step 89. In step 89, the reading address pointer of the pattern memory is incremented. By this address increment, next address of the timing data, i.e., the address at which the event data is stored in the pattern memory is designated (see FIG. 3). In next step 90, the event data is read from the designated address and is supplied to the tone source circuit for generation of the rhythm tone signal corresponding to the event data. In next step 91, the pattern end detection processing shown in FIG. 10 is executed.

In this pattern end detection processing, in step 96, whether or not the address which is currently indicated by the address pointer is the last address of the pattern is examined. When step 96 is NO, the routine proceeds to step 97 where the address pointer is incremented. By this address increment, next address of the event data, i.e., address at which timing data is stored is designated in the pattern data memory (see FIG. 3). In next step 98, the timing data is read from the designated address and set in the time interval register TINT and, thereafter, this pattern end detection processing is ended.

Reverting to FIG. 9, after the pattern end detection processing of step 91, the routine proceeds to step 92 where whether the value of the tempo timing register TIME is 95 or not is examined. When step 92 is NO, the routine proceeds to step 93 in the same manner as described above and TIME is increased by 1.

In this manner, when one tone has been generated according to the pattern, timing data of a next tone to be generated is set in the time interval register TINT and compared in step 88 in the same manner as described previously. By this arrangement, the automatic rhythm tone is sequentially generated in accordance with a selected or designated pattern.

Step 92 becomes YES at the last tempo timing of one bar and the routine proceeds to step 94. In step 94, a bar end detection processing shown in FIG. 11 is executed. In this bar end detection processing, a processing for changing the pattern in synchronism with start of next bar is performed.

First, in steps 99, 100 and 101, whether or not the next fill-in-to normal flag NFTN, next fill-in-to-variation flag NETV and next end flag NEDN are respectively "1" is examined. When these flags are all "0", this bar end detection processing is immediately ended. Upon ending of the bar end detection processing, the routine proceeds from step 94 to step 95 of FIG. 9 and the value of the tempo timing register TIME is set to the initial value 0 and then returns.

Automatic selection of the fill-in pattern (2)

When the next fill-in-to-normal flag NFTN is "1", step 99 of FIG. 11 becomes YES and the routine proceeds to step 101. This indicates that one bar of the normal pattern or variation pattern immediately before the fill-in has just ended and the performance according to the fill-in pattern should be made from the beginning of next bar and should be followed by the performance according to the normal pattern. In step 102, the flag NFTN is reset to "0" and the fill-in-to-normal flag FTN is set to "1". Processing of next steps 103, 104 and 105 is the same as the processing of steps 66, 67 and 69 of FIG.

7. That is, the "N→N fill-in pattern" or the "V→N fill-in pattern" is automatically selected in accordance with the performance pattern immediately before the fill-in performance.

Processing of next step 106 is the same as the processing of step 98 of FIG. 10. That is, timing data is read from a designated address and set in the time interval register TINT. Thereafter, the bar end detection processing is ended and the routine proceeds to step 95 of FIG. 9.

When the next-fill-in-to-variation flag NFTV is "1", step 100 of FIG. 11 becomes YES and the routine proceeds to step 107. This indicates that one bar of the normal pattern or variation pattern immediately before the fill-in has just ended and the performance according to the fill-in pattern should be made from the beginning of next bar and should be followed by the performance according to the variation pattern. In step 107, the flag NFTV is reset to "0" and the fill-in-to-variation flag FTV is set to "1". Processing of next steps 108, 109 and 110 is the same as the processing of steps 73, 74 and 76 of FIG. 8. That is, the "N→V fill-in pattern" or "V→V fill-in pattern" is automatically selected in accordance with the performance pattern immediately before the fill-in performance. Then, processing of step 106 is executed and the bar end detection processing is thereby ended. Then the routine proceeds to step 95 of FIG. 9.

When the next ending flag NEND is "1", step 101 of FIG. 11 becomes YES and the routine proceeds to step 111. This indicates that one bar of the normal pattern or variation pattern immediately before the fill-in has just ended and the performance according to the ending pattern should be made from the beginning of next bar. In step 111, the flag NEND is reset to "0" and the ending flag END is set to "1". Processing of next steps 112, 113 and 114 is the same as the processing of steps 80, 81 and 83 of FIG. 6. That is, the "normal ending pattern" or the "variation ending pattern" is automatically selected in accordance with the performance pattern immediately before the ending performance. Then processing of step 106 is executed and the bar end detection processing is thereby ended. Then, the routine proceeds to step 95 of FIG. 9.

Processing at the end of the pattern

At the end of the performance pattern, a judgement of YES is made in step 96 in the pattern end detection processing of FIG. 10 and the routine proceeds to step 115. In step 115, whether the fill-in-to-normal flag FTN is "1" or not is examined. When the pattern which has been performed so far is the "N→N fill-in pattern" or the "V→N fill-in pattern", this flag FTN is "1" and the routine proceeds to step 116. In step 116, the flag FTN is reset to "0" and the normal pattern flag NORM is set to "1". Then, in step 117, processing for designating the head address of the normal pattern is executed in the same manner as in step 62 of FIG. 5 and thereafter the routine proceeds to step 98. After making the performance according to the "N→N fill-in pattern" or the "V→N fill-in pattern" to the end, the performance is shifted to the performance according to the normal pattern. The processing of this part corresponds to the processing of the route designated by reference characters **5*b* and 6*b* of FIG. 1**.

When step 115 is NO, the routine proceeds to step 118. In step 118, whether the introduction flag INTRO is "1" or not is examined. When the pattern which has been performed so far is the introduction pattern, this flag INTRO is "1" and the routine proceeds to step 119. In step 119, whether the normal pattern flag NORM is "1" or not is examined and, when step 119 is YES, the routine proceeds to the above described step 117. This indicates that the pattern which has been performed so far is the normal introduction pattern and the performance is shifted to the performance according to the normal pattern after ending of the normal introduction pattern.

When the normal pattern flag NORM is "0", this indicates that the pattern which has been performed so far is the variation introduction pattern. In this case, the routine proceeds from NO of step 120 to step 123 and, in the same manner as in step 63 of FIG. 5, a processing for designating the head address of the variation pattern is executed. Then, the routine proceeds to step 98. Accordingly, the performance is shifted to the performance according to the variation pattern after the variation introduction pattern has ended.

When step 118 is NO, the routine proceeds to step 121 where whether the fill-in-to-variation flag FTV is "1" or not is examined. When the pattern which has been performed so far is the "N→V fill-in pattern" or the "V→V fill-in pattern", this flag FTV is "1" and the routine proceeds to step 122. In step 122, the flag FTV is reset to "0" and the normal pattern flag NORM is reset to "0". Then, the processing of the above described step 123 is executed. Thus, after making the performance according to the "N→V fill-in pattern" or the "V→V fill-in pattern" to the end, the performance is shifted to the performance according to the variation pattern. The processing of this part corresponds to the processing of the route designated by reference characters **7*b* and 8*b* of FIG. 1**.

When step 121 is NO, the routine proceeds to step 124 where whether the ending flag END is "1" or not is examined. When the pattern which has been performed so far is the ending pattern, this flag END is "1" and the routine proceeds to step 125 where the flag END is reset to "0" and the RUN flag is reset to "0". Then, the routine returns. By resetting the RUN flag to "0", the automatic performance is ended.

On the other hand, when the ending flag END is "0", step 124 is NO and the routine proceeds to step 126 where whether the normal pattern flag NORM is "1" or not is examined. When step 126 is "1", the routine proceeds to the above described step 117 whereas when step 126 is "0", the routine proceeds to the above described step 123. When no particular pattern change processing or ending processing is executed, the routine arrives at this step 126 so that the automatic performance according to the normal pattern or variation pattern is repeated.

Special processing in the fill-in performance

Description will now be made about an embodiment in which an arrangement is made for coping with a case where, during a fill-in performance, an operation for designating another fill-in performance has been made. In this embodiment, the flow charts of FIGS. 7 and 8 in the above described embodiment are modified as indicated by flow charts of FIGS. 13 and 14 and in other respects the embodiment is of the same construction as the above described embodiment.

Figure 13:
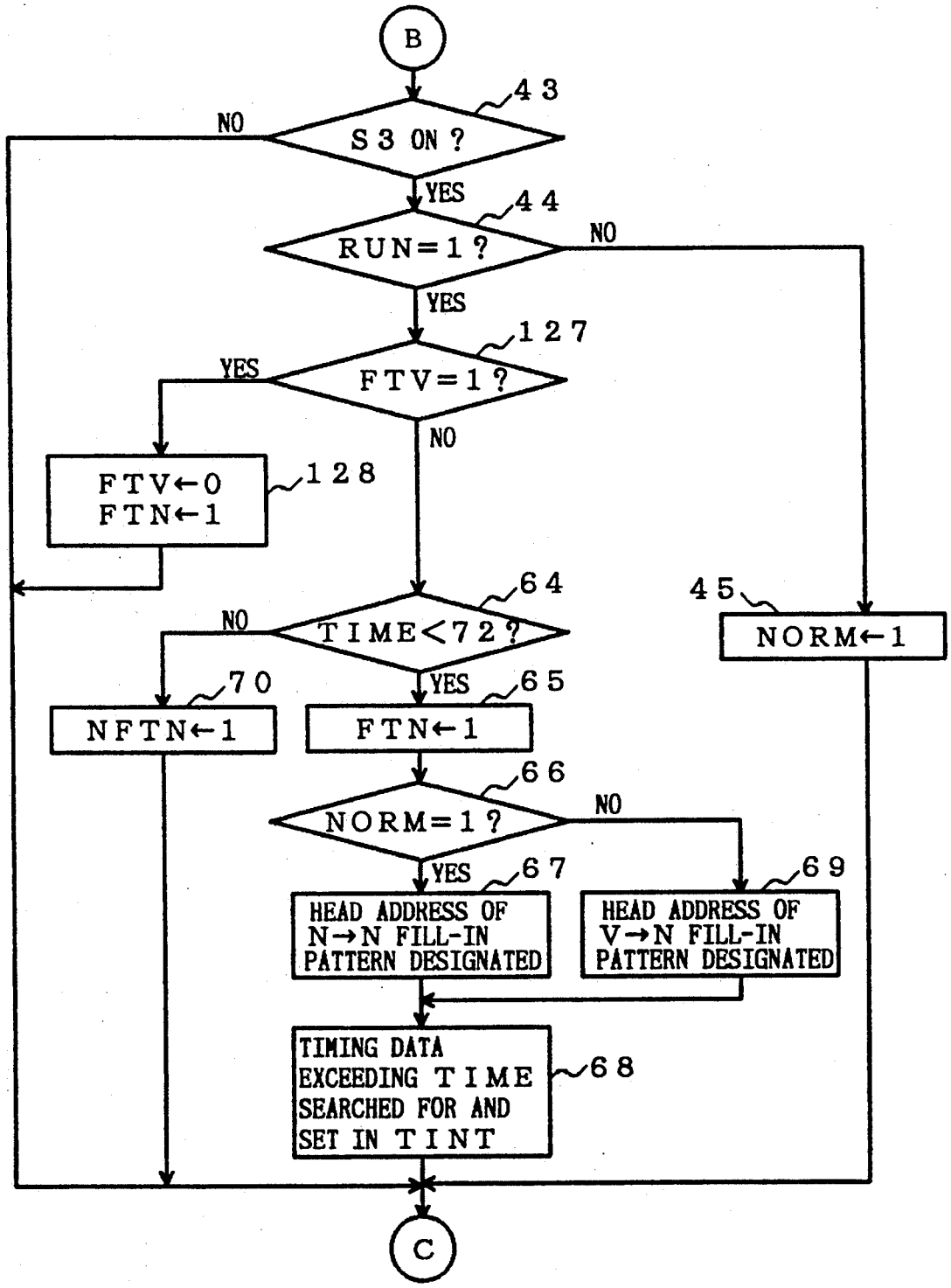
FIG. 13 is a flow chart showing a modified example of FIG. 7.
Figure 14:
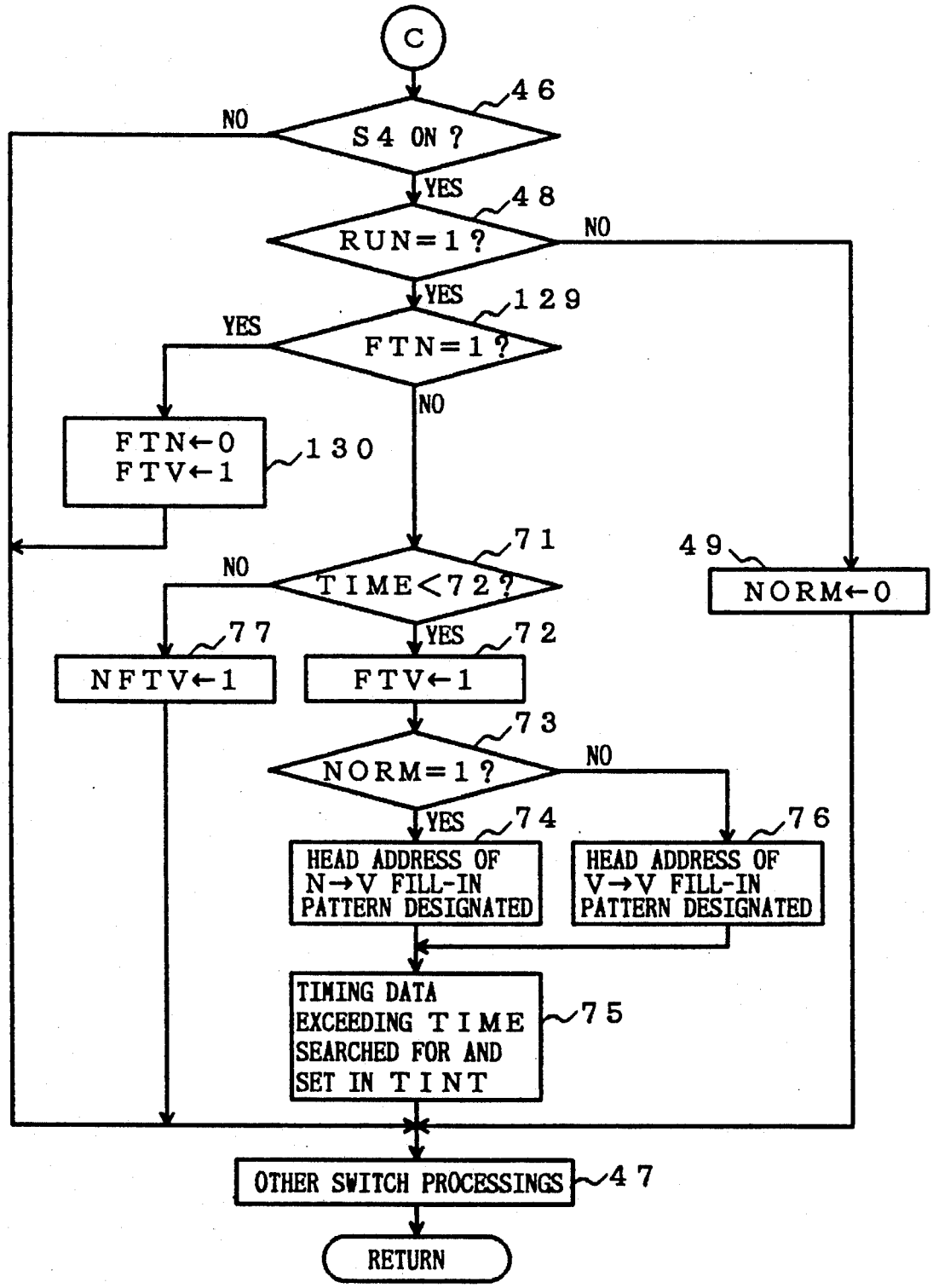
FIG. 14 is a flow chart showing a modified example of FIG. 8.

The modified parts are that, in FIG. 13, steps 127 and 128 are added between step 44 and step 64 of FIG. 7 and that, in FIG. 14, steps 129 and 130 are added between step 48 and step 71 of FIG. 8.

Referring first to FIG. 13, when designation of the "fill-in-to-normal" has been made during performance according to the main pattern, the switch S3 is turned on and, accordingly, YES judgement is made in step 43 of FIG. 13 and the routine proceeds to step 44. In this step, a judgement of RUN=1 YES is made. In the example of FIG. 7, the routine proceeds directly to step 64 when step 44 is YES to execute the "fill-in-to-normal" processing. The routine in FIG. 13 is different and it proceeds to step 127. In step 127, whether the fill-in-to-variation flag FTV is set to "1" or not is examined. In the present case, the main pattern is being performed and, therefore, FTV is "0" and step 127 thereby becomes NO and the routine proceeds to step 64. Accordingly, the same processing as in FIG. 7 is executed.

Nextly, description will be made about a case where the designation of the "fill-in-to-normal" has been made when the fill-in-to-variation flag FTV is set to "1" and the performance according to the "N→V fill-in pattern" or "V→V fill-in pattern" is being made. Since, in this case, the switch S3 is turned on, judgements of YES are made in steps 43 and 44 of FIG. 13 and the routine proceeds to step 127. In this case, the flag FTV is "1" and, therefore, step 127 is YES and the routine proceeds to step 128. In step 128, the flag FTV is reset to "0" and the fill-in-to-normal flag FTN is set to "1". Then, the routine does not proceed to step 64 but jumps to step 46 of FIG. 14. Accordingly, the routine does not proceed through the route of step 64, so that the fill-in pattern of the fill-in-to-variation which is being performed is not altered but is continued. On the other hand, the flag FTN is switched to "1" and the main pattern to be performed is thereby changed from the variation pattern to the normal pattern.

In steps 129 and 130 added in FIG. 14, the normal pattern in steps 127 and 128 added in FIG. 13 is replaced by the variation pattern but these steps 129 and 130 are otherwise constructed on the same concept as in steps 127 and 128.

According to the embodiments of FIGS. 13 and 14, therefore, in a case where, during performance of a transitional performance according to one sub-pattern (first fill-in performance), an instruction has been made to insert a performance according to another sub-pattern (second fill-in performance) and thereby shift the performance to one according to another main pattern, the sub-pattern which is being performed is not changed but processing for changing only the main pattern to be performed subsequently is executed. Accordingly, when the operation for designating the second fill-in performance has been made during the first fill-in performance, continuity of the fill-in under performance is secured while, as to the main pattern to be shifted subsequently, one which is designated later is given priority, so that a reasonable processing is ensured.

The concept of the special processing shown in FIGS. 13 and 14 is applicable not only to the automatic performance device of the above described type in which the fill-in pattern is determined having regard to the combination of main patterns before and after the fill-in but to an automatic performance device of a type in which the fill-in pattern (or a break pattern or ad lib pattern) is determined solely in accordance with the main pattern to be performed after shifting.

Application to the automatic bass/chord performance

In the above described embodiments, this invention has been applied to the automatic rhythm performance. A similar constitution can be applied also to the automatic bass/chord performance. Embodiments thereof are shown in FIGS. 15 and 16.

Figure 15:
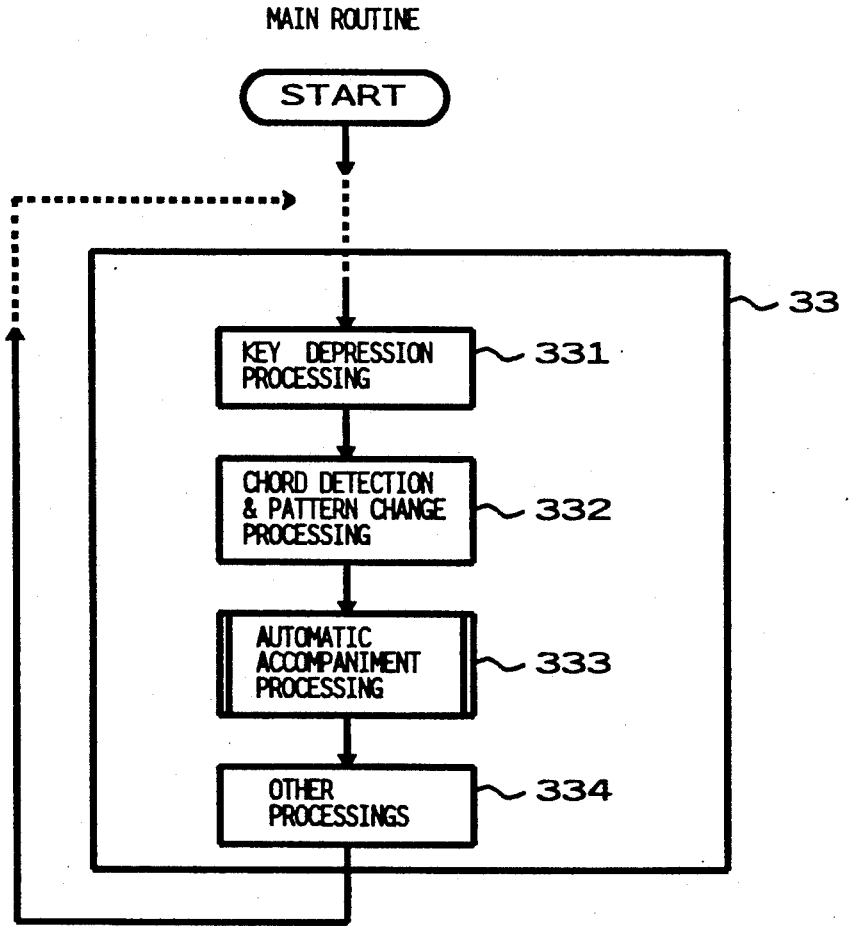
FIG. 15 is a diagram showing an embodiment of the invention applied to the automatic bass/chord performance in the form of a flow chart showing processing relating to the automatic bass/chord performance in the main routine.
Figure 16:
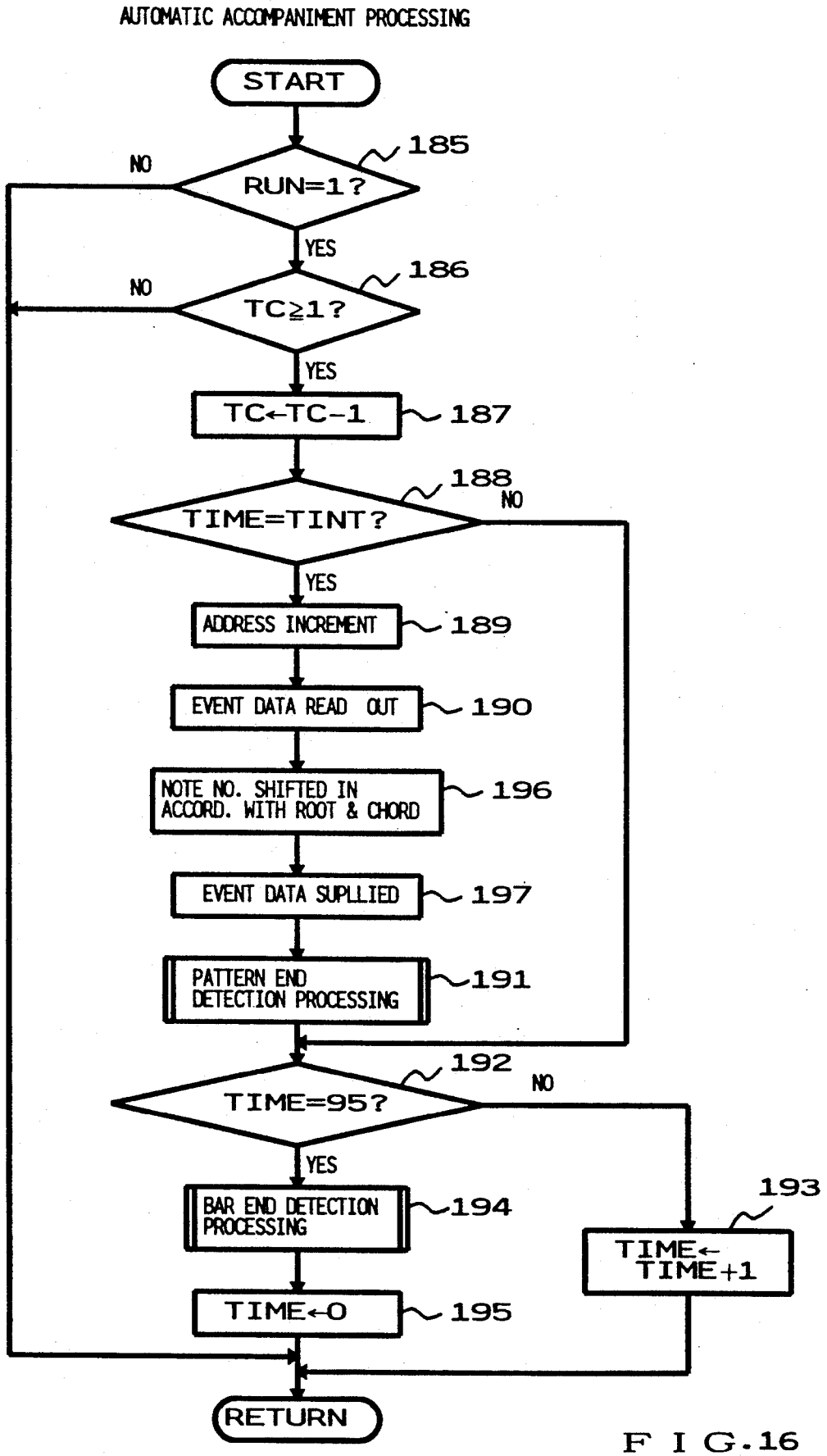
FIG. 16 is a flow chart showing a specific example of the automatic performance processing in FIG. 15.

FIG. 15 is a modified example of the main routine and shows processing relating to the automatic bass/chord performance executed in the portion of other processing (step 33) in the main routine of FIG. 4. In step 331, key depression processing is executed. In this step, depression and release of keys in the keyboard 14 are detected and processing relating thereto is executed. In step 332, processing for detecting a chord from a depressed key in a predetermined keyboard (or key range) provided for the accompaniment purpose and processing for changing the performance pattern in accordance with the detected chord are executed. In the automatic bass/chord performance also, the main patterns consist basically of the normal pattern and the variation pattern. However, having regard to the special characteristics of the automatic bass/chord performance which is performed in a pattern suited to an accompaniment chord, plural normal patterns and variation patterns are respectively provided in correspondence to plural chord types (e.g., three types of major, minor and minor seventh) and the type of the normal pattern or variation pattern used is changed depending upon the detected chord type.

In step 333, an automatic accompaniment processing is executed. This automatic accompaniment processing corresponds to the above described automatic rhythm processing (step 32) and a specific example thereof is shown in FIG. 16. In step 334, other processings are executed.

For the control switch group 16B, switches may be used commonly for the automatic rhythm and the automatic bass/chord performance or separate switches used exclusively for either function may be provided. The flow charts of the panel switch processing shown in FIGS. 5 through 8 may be utilized directly for processing for the automatic bass/chord performance. The format of the pattern data memory storing patterns of the automatic bass/chord performance may be the same as the one shown in FIG. 3. It should however be noted that contents of the pattern data differ entirely between the rhythm and the automatic bass/chord.

In the automatic accompaniment processing of FIG. 16, processing in steps 185–195 may be considered to be the same as the processing in steps 85–95 in FIG. 9. Difference resides only in that steps 196 and 197 are provided between steps 190 and 191. In step 190, the event data for the automatic accompaniment read from the pattern data memory is read out. The note number in the read out event data is data representing tone pitch of a tone to be generated as a bass tone or a chord tone, i.e., an accompaniment, by a relative scale from a root note. In step 196, this data of relative scale is shifted in numerical value in accordance with the root note name of the detected chord and the type of the chord and converted to absolute scale data. In step 197, the converted scale data is supplied to the tone source circuit 19 to generate an accompaniment tone signal such as a bass tone or a chord tone on the basis of the converted scale data.

A pattern end detection processing 191 in FIG. 16 may be considered to be the same processing as the processing in FIG. 10 and a bar end detection processing 194 may be considered to be the same as the processing in FIG. 11.

By the above described construction, the control according to the invention can be carried out also in the automatic accompaniment such as the automatic bass/-chord performance with a similar pattern change system as was described with reference to FIG. 1.

In the above described embodiments, the two types of main patterns, i.e., the normal and variation patterns, are employed. The number of types of main pattern is not limited to two but more types may be employed. The variation pattern may be selected from among plural variation patterns.

The memory format of the pattern data is not limited to the type as shown in FIG. 3 in which timing data and event data are stored for each event. For example, plural addresses may be set in correspondence to the minimum tempo clock timing, data of tone to be generated may be stored at an address corresponding to a tempo clock timing at which the tone should be generated, and the respective addresses may be sequentially accessed according to the tempo clock timing to read out the stored data.

In the above described embodiments, the automatic performance is started by operation of the start/stop switch. Alternatively, the known synchronized start system according to which the automatic rhythm is started in synchronism with the key depression may be employed.

In the above described embodiments, each of the switches S1–S4 is used commonly for performing two functions. The invention is not limited to this but designation means or selection means such as a switch may be provided for each individual function.

In the above described embodiments, processing for changing the performance pattern from midway of a bar is made by using the middle of the bar or the fourth beat as the changing point. The changing point however is not limited to this.

As described in the foregoing, according to the invention, in a case where a performance according to a sub-pattern such as fill-in is temporarily inserted during a performance, the sub-pattern is automatically selected having regard not only to a main pattern to which the pattern should be shifted after the sub-pattern but to a main pattern which has been performed immediately before the sub-pattern. Accordingly, such transitional performance can be automatically carried out with various modes of change in accordance with a combination of main performances before and after the transitional performance whereby monotonousness of such transitional performance as fill-in can be prevented and the function of the automatic performance can be improved.

Further, according to the invention, in a case where an introduction performance is inserted at the beginning of the automatic performance, an introduction pattern is automatically selected with various modes of changes depending upon which main pattern is performed after the introduction performance. Accordingly, an introduction performance full of variety can be carried out and the function of the automatic performance can be improved.

Further, according to the invention, in a case where an ending performance is inserted at the end of the automatic performance, an ending pattern is automatically determined in accordance with the main pattern which has been performed immediately before. Accordingly, the ending pattern can be automatically determined with various modes of change depending upon which main pattern has been performed immediately before the ending whereby monotonousness of an ending performance can be prevented and the function of the automatic performance can be improved.

Further, according to the invention, in a case where, during a transitional performance such as fill-in, an operation for designating another transitional performance such as fill-in has been made, continuity of the transitional performance can be secured and, in the meanwhile, as to the main pattern to which the pattern should be shifted, one which is designated later is given priority so that processing can be performed without inconvenience and the function of the automatic performance can thereby be improved.

We claim:

1. An automatic performance device comprising:

performance pattern memory means for storing plural main patterns and plural sub-patterns;

selection means for selecting a desired first main pattern;

first control means for reading out the first main pattern selected by said selection means from said memory means and carrying out an automatic performance of the read out main pattern;

instruction means for designating a second main pattern, so as to instruct temporarily inserting a performance of a sub-pattern during the automatic performance and then shifting to a performance of the second main pattern;

determination means responsive to the designation by said instruction means for automatically determining the sub-pattern to be inserted in accordance with a combination of the second main pattern designated by said instruction means and the first main pattern which has been performed immediately before the designation; and second control means for reading out the sub-pattern determined by said determination means from said memory means and carrying out the automatic performance of the sub-pattern and, thereafter, reading out the second main pattern designated by said instruction means from said memory means and carrying out an automatic performance of the second main pattern.

2. An automatic performance device as defined in claim 1 wherein said instruction means includes as many switches as the main patterns which are capable of being designated thereby.

3. An automatic performance device as defined in claim 1 wherein a number (S) of the sub-patterns is equivalent to a square of a number (M) of the plural main patterns; i.e., $S=M^2$.

4. An automatic performance device as defined in claim 1 wherein said sub-pattern is a pattern for realizing a fill-in performance, and said instruction means includes a switch for instructing the fill-in performance.

5. An automatic performance device comprising:

performance pattern memory means for storing plural main patterns prepared for each of plural styles, and plural introduction patterns;

first selection means for selecting a desired style from among the plural styles;

second selection means for selecting a desired main pattern from among the plural main patterns of the style selected by said first selection means;

introduction performance instruction means for instructing an automatic performance of an introduction pattern at the beginning of an automatic performance;

introduction pattern determination means responsive to the instruction by said introduction performance instruction means for automatically determining an introduction pattern in accordance with the main pattern selected by said second selection means;

control means for reading out the introduction pattern determined by said introduction pattern determination means from said memory means and carrying out the automatic performance of the introduction pattern and, thereafter, reading out the main pattern selected by said second selection means from said memory means and carrying out an automatic performance of the main pattern.

6. An automatic performance device as defined in claim 5 wherein a number of the plural introduction patterns is identical with the number of the plural main patterns.

7. An automatic performance device comprising:

performance pattern memory means for storing plural main patterns prepared for each of plural styles, and plural ending patterns;

first selection means for selecting a desired style from among the plural styles;

second selection means for selecting a desired main pattern from among the plural main patterns of the style selected by said first selection means;

first control means for reading out the main pattern selected by said second selection means from said memory means and carrying out an automatic performance of the read out main pattern;

ending performance instruction means for designating an automatic performance of an ending pattern at the end of the automatic performance;

ending pattern determination means responsive to the instruction by said ending performance instruction for automatically determining an ending pattern in accordance with the main pattern which has been performed immediately before the instruction; and second control means for reading out the ending pattern determined by said ending pattern determination means from said memory means and carrying out the automatic performance of the ending pattern.

8. An automatic performance device as defined in claim 7 wherein a number of the plural ending patterns is identical with the number of the plural main patterns.

9. An automatic performance device comprising:

performance pattern memory means for storing plural main patterns and plural sub-patterns;

instruction means for, when an automatic performance is being carried out, instructing temporarily inserting a performance of a sub-pattern and then shifting to a performance of a desired main pattern;

first control means responsive to the instruction by said instruction means for reading out the sub-pattern from said memory means and carrying out an automatic performance of the read out sub-pattern and, thereafter, reading out the desired main pattern from said memory means and carrying out an automatic performance of the desired main pattern; and second control means for controlling said first control means in a manner that when, during the automatic performance of the read out sub-pattern, said instruction means also instructs temporarily inserting a performance of another sub-pattern and then shifting to a performance of another main pattern, a main pattern to be performed thereafter will be changed from the desired main pattern to the other main pattern without changing the automatic performance of the read out sub-pattern to that of the other sub-pattern.

10. An automatic performance device as defined in claim 9 wherein said instruction means includes as many switches as the plural main patterns.

11. An automatic performance device as defined in claim 9 wherein a number (S) of the sub-patterns is equivalent to a square of a number (M) of the plural main patterns; i.e., $S=M^2$.

* * * * *